US010465521B2

(12) United States Patent
Snider et al.

(10) Patent No.: US 10,465,521 B2
(45) Date of Patent: Nov. 5, 2019

(54) TURBINE AIRFOIL COOLANT PASSAGE CREATED IN COVER

(71) Applicant: General Electric Company, Schenectady, NY (US)

(72) Inventors: Zachary John Snider, Simpsonville, SC (US); Gregory Thomas Foster, Greer, SC (US); Srikanth Chandrudu Kottilingam, Greenville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 15/334,483

(22) Filed: Oct. 26, 2016

(65) Prior Publication Data

US 2018/0112534 A1 Apr. 26, 2018

(51) Int. Cl.

*F01D 5/14* (2006.01)
*F01D 5/18* (2006.01)
*F01D 5/28* (2006.01)

(52) U.S. Cl.

CPC ..... *F01D 5/147* (2013.01); *F01D 5/187* (2013.01); *F01D 5/286* (2013.01); *F05D 2240/304* (2013.01)

(58) Field of Classification Search

CPC .... F01D 5/186; F01D 5/187; F05D 2240/304; F05D 2260/204

See application file for complete search history.

(56) References Cited

U.S. PATENT DOCUMENTS 2,744,723 A 5/1956 Roush
3,220,697 A 11/1965 Smuland et al.
3,844,679 A 10/1974 Grondahl et al.
3,849,025 A 11/1974 Grondahl
4,021,139 A 5/1977 Franklin
4,302,153 A 11/1981 Tubbs
4,684,322 A 8/1987 Clifford et al.
4,761,116 A 8/1988 Braddy et al.

(Continued)

FOREIGN PATENT DOCUMENTS

EP 1533474 A2 5/2005
EP 1793085 A2 6/2007

OTHER PUBLICATIONS

U.S. Appl. No. 15/334,563, Office Action dated Dec. 12, 2018, 18 pages.

(Continued)

*Primary Examiner* — Nathaniel E Wiehe

(74) *Attorney, Agent, or Firm* — Dale Davis; Hoffman Warnick LLC

(57) ABSTRACT

A turbine airfoil for a rotating blade or stationary nozzle vane includes an airfoil body including a leading edge and a trailing edge. A coolant supply passage extends within the airfoil body and a coolant return passage extends within the airfoil body, with each passage having respective a supply and return connection passage to an exterior surface of the airfoil body. A seat in the exterior surface of the airfoil body receives a cover that includes a trench on an interior surface thereof to fluidly connect the return connection passage and the supply connection passage and form a coolant passage for the airfoil body. Various arrangements of cooling circuits may be created with the cover that allow for reuse of the coolant.

18 Claims, 16 Drawing Sheets

(56) References Cited

U.S. PATENT DOCUMENTS

| | | | | |
|---|---|---|---|---|
| 4,940,388 | A | 7/1990 | Lilleker et al. | |
| 5,100,293 | A | 3/1992 | Anzai et al. | |
| 5,236,309 | A | 8/1993 | Van Heusden et al. | |
| 5,350,277 | A | 9/1994 | Jacala et al. | |
| 5,464,322 | A | 11/1995 | Cunha et al. | |
| 5,536,143 | A | 7/1996 | Jacala et al. | |
| 5,915,923 | A | 6/1999 | Tomita et al. | |
| 5,967,752 | A | 10/1999 | Lee et al. | |
| 5,997,251 | A | 12/1999 | Lee | |
| 6,099,252 | A | 8/2000 | Manning et al. | |
| 6,227,804 | B1 | 5/2001 | Koga et al. | |
| 6,247,896 | B1 | 6/2001 | Auxier et al. | |
| 6,422,817 | B1 | 7/2002 | Jacala | |
| 6,499,949 | B2 | 12/2002 | Schafrik et al. | |
| 6,547,522 | B2 | 4/2003 | Turnquist et al. | |
| 6,547,525 | B2 | 4/2003 | Haehnle et al. | |
| 7,435,053 | B2 | 10/2008 | Liang | |
| 7,530,789 | B1 | 5/2009 | Liang | |
| 7,670,113 | B1 | 3/2010 | Liang | |
| 7,717,675 | B1 | 5/2010 | Liang | |
| 7,785,070 | B2 | 8/2010 | Liang | |
| 7,845,906 | B2 | 12/2010 | Spangler et al. | |
| 7,985,049 | B1 | 7/2011 | Liang | |
| 8,047,788 | B1 | 11/2011 | Liang | |
| 8,142,153 | B1 | 3/2012 | Liang | |
| 8,317,472 | B1 | 11/2012 | Liang | |
| 8,322,988 | B1 * | 12/2012 | Downs | F01D 5/147 416/96 A |
| 8,398,370 | B1 | 3/2013 | Liang | |
| 8,444,386 | B1 | 5/2013 | Liang | |
| 8,562,295 | B1 | 10/2013 | Liang | |
| 8,608,430 | B1 * | 12/2013 | Liang | F01D 5/187 415/115 |
| 8,628,298 | B1 | 1/2014 | Liang | |
| 8,678,766 | B1 | 3/2014 | Liang | |
| 8,790,083 | B1 | 7/2014 | Liang | |
| 8,864,469 | B1 | 10/2014 | Liang | |
| 9,145,780 | B2 | 9/2015 | Propheter-Hinckley et al. | |
| 9,447,692 | B1 | 9/2016 | Liang | |
| 9,970,302 | B2 | 5/2018 | Lacy et al. | |
| 2005/0058534 | A1 | 3/2005 | Lee et al. | |
| 2009/0028702 | A1 | 1/2009 | Pietraszkiewicz et al. | |
| 2009/0193657 | A1 | 8/2009 | Wilson, Jr. et al. | |
| 2010/0303625 | A1 | 12/2010 | Kuhne et al. | |
| 2013/0108471 | A1 | 5/2013 | Fujimoto | |
| 2013/0272850 | A1 | 10/2013 | Bunker | |
| 2014/0093379 | A1 | 4/2014 | Tibbott et al. | |
| 2014/0127013 | A1 | 5/2014 | Spangler et al. | |
| 2015/0041590 | A1 | 2/2015 | Kirtley et al. | |
| 2015/0044059 | A1 | 2/2015 | Wassynger et al. | |
| 2015/0096305 | A1 | 4/2015 | Morgan et al. | |
| 2015/0147164 | A1 * | 5/2015 | Cui | F01D 5/188 415/175 |
| 2015/0252728 | A1 | 9/2015 | Veiga | |
| 2015/0345303 | A1 | 12/2015 | Dong et al. | |
| 2016/0169003 | A1 | 6/2016 | Wong et al. | |
| 2016/0177741 | A1 | 6/2016 | Kirollos et al. | |
| 2017/0234154 | A1 | 8/2017 | Downs | |
| 2017/0350259 | A1 | 12/2017 | Dutta et al. | |
| 2018/0230815 | A1 | 8/2018 | Jones | |

OTHER PUBLICATIONS

U.S. Appl. No. 15/334,474, Office Action dated Dec. 31, 2018, 13 pages.
U.S. Appl. No. 15/334,450, Notice of Allowance dated Jan. 10, 2019, 12 pages.
U.S. Appl. No. 15/334,501, Notice of Allowance dated Jan. 17, 2019, 11 pages.
U.S. Appl. No. 15/334,454, Notice of Allowance dated Jan. 24, 2019, 23 pages.
U.S. Appl. No. 15/334,585, Final Office Action dated Feb. 8, 2019, 20 pages.
U.S. Appl. No. 15/334,585, Office Action dated Jul. 31, 2018, 22 pages.
U.S. Appl. No. 15/334,517, Office Action dated Aug. 6, 2018, 24 pages.
U.S. Appl. No. 15/334,501, Office Action dated Aug. 10, 2018, 17 pages.
U.S. Appl. No. 15/334,450, Office Action dated Aug. 15, 2018, 49 pages.
U.S. Appl. No. 15/334,517, Notice of Allowance dated Mar. 20, 2019, 9 pgs.
U.S. Appl. No. 15/334,563, Notice of Allowance dated Apr. 9, 2019, 8 pgs.
U.S. Appl. No. 15/334,474, Notice of Allowance dated Apr. 17, 2019, 16 pgs.
U.S. Appl. No. 15/334,448, Office Action dated May 14, 2019, 8 pages.
EP Search Report for corresponding European Patent Application No. 17198212 dated May 9, 2018, 7 pages.
U.S. Appl. No. 15/334,585 Notice of Allowance dated Jun. 7, 2019, 21 pgs.
U.S. Appl. No. 15/334,448, Notice of Allowance dated Jun. 19, 2019, 13 pages.
U.S. Appl. No. 15/334,471, Office Action dated Jul. 11, 2019, 13 pages.

* cited by examiner

TURBINE AIRFOIL COOLANT PASSAGE CREATED IN COVER

This application is related to co-pending U.S. application Ser. Nos. 15/334,474 15/334,454 15/334,563 15/334,585 15/334,448 15/334,501 15/334,517 15/344,450 15/334,471, all filed on Oct. 26, 2016.

BACKGROUND OF THE INVENTION

The disclosure relates generally to turbomachines, and more particularly, to a turbine airfoil having a near wall, trailing edge cooling circuit formed in a cover and allowing coolant recycling.

Gas turbine systems are one example of turbomachines widely utilized in fields such as power generation. A conventional gas turbine system includes a compressor section, a combustor section, and a turbine section. During operation of a gas turbine system, various components in the system, such as turbine blades and nozzle/vane airfoils, are subjected to high temperature flows, which can cause the components to fail. Since higher temperature flows generally result in increased performance, efficiency, and power output of a gas turbine system, it is advantageous to cool the components that are subjected to high temperature flows to allow the gas turbine system to operate at increased temperatures.

A multi-wall rotating blade or stationary nozzle typically contains an intricate maze of internal cooling passages. Cooling air provided by, for example, a compressor of a gas turbine system, may be passed through and out of the cooling passages to cool various portions of the multi-wall blade. Cooling circuits formed by one or more cooling passages in a multi-wall blade/nozzle may include, for example, internal near wall cooling circuits, internal central cooling circuits, tip cooling circuits, and cooling circuits adjacent the leading and trailing edges of the multi-wall blade. In order to cool a tip of a trailing edge of a turbine airfoil and because the trailing edge provides very little internal space for defining a cooling circuit, coolant for the trailing edge is typically delivered in one or both of the following ways. In one approach, the airfoils include a coolant passage(s) that delivers a coolant through and out of the trailing edge, and in another approach, coolant is delivered out a side of the airfoil and across an exterior surface immediately upstream of the tip of the leading edge. In either approach, the coolant is delivered only in a single, downstream direction out to the hot gas path of the turbine. Once the coolant leaves the airfoil it is lost and cannot be recycled for cooling other parts.

BRIEF DESCRIPTION OF THE INVENTION

A first aspect of the disclosure provides a turbine airfoil, comprising: an airfoil body including a leading edge and a trailing edge; a coolant supply passage extending within the airfoil body; a coolant return passage extending within the airfoil body; a first trench in an external surface of the airfoil body, the first trench extending to the trailing edge and being in fluid communication with the coolant supply passage; a second trench in the external surface of the airfoil body, the second trench extending to the trailing edge and being in fluid communication with the coolant return passage and the first trench; and a seat in an exterior surface of the airfoil body for receiving a cover configured to enclose the first and second trenches and form coolant passages with the airfoil body.

A second aspect of the disclosure provides a turbine blade or nozzle, comprising: an airfoil body including a leading edge and a trailing edge; a coolant supply passage extending within the airfoil body; a coolant return passage extending within the airfoil body; a first trench in an external surface of the airfoil body, the first trench extending to the trailing edge and being in fluid communication with the coolant supply passage; a second trench in the external surface of the airfoil body, the second trench extending to the trailing edge and being in fluid communication with the coolant return passage and the first trench; a cover seat in an exterior surface of the airfoil body; and a cover positioned in the cover seat and enclosing the first and second trenches to form coolant passages with the airfoil body.

A third aspect of the disclosure provides a turbine blade or nozzle, comprising: an airfoil body including a leading edge and a trailing edge; a coolant supply passage extending within the airfoil body; a coolant return passage extending within the airfoil body; a first trench in an external surface of the airfoil body, the first trench extending to the trailing edge and being in fluid communication with the coolant supply passage; a second trench in the external surface of the airfoil body, the second trench extending to the trailing edge and being in fluid communication with the coolant return passage and the first trench; and a cover seat in an exterior surface of the airfoil body; and a cover positioned in the cover seat and enclosing the first and second trenches to form coolant passages with the airfoil body, wherein each trench has a first radial extent and a second radial extent, the first radial extent at a location upstream of a second radial extent and the second radial extent being larger than the first radial extent, and wherein the trailing edge is devoid of any coolant passage exiting through the trailing edge.

A fourth aspect of the disclosure provides a turbine airfoil, comprising: an airfoil body including an exterior surface, a leading edge and a trailing edge; a coolant supply passage extending within the airfoil body, the coolant supply passage including a supply connection passage extending to the exterior surface of the airfoil body; a coolant return passage extending within the airfoil body, the coolant return passage including a return connection passage extending to the exterior surface of the airfoil body; and a seat in the exterior surface of the airfoil body for receiving a cover that includes a trench on an interior surface thereof to fluidly connect the return connection passage and the supply connection passage and form a coolant passage for the airfoil body.

A fifth aspect provides a turbine blade or nozzle, comprising: an airfoil body including an exterior surface, a leading edge and a trailing edge; a coolant supply passage extending within the airfoil body, the coolant supply passage including a supply connection passage extending to a portion of the exterior surface of the airfoil body; a coolant return passage extending within the airfoil body, the coolant return passage including a return connection passage extending to the portion of the exterior surface of the airfoil body; a cover seat adjacent the portion of the exterior surface of the airfoil body; and a cover positioned in the cover seat and covering the portion of the exterior surface of the airfoil body, the cover including a trench on an interior surface thereof to fluidly connect the return connection passage and the supply connection passage and form a coolant passage for the airfoil body.

A sixth aspect relates to a cover for an edge of an airfoil body of a turbine airfoil, the cover comprising: an angled member configured to cover the edge of the airfoil body, the angled member including a suction side portion and a pressure side portion coupled to the suction side portion at an angle at a connection region, and an interior surface including a trench for fluidly connecting a coolant supply connection passage in a portion of an exterior surface of the airfoil body with a coolant return connection passage in the portion of the exterior surface of the airfoil body and forming a coolant passage for the turbine airfoil.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

Figure 1:
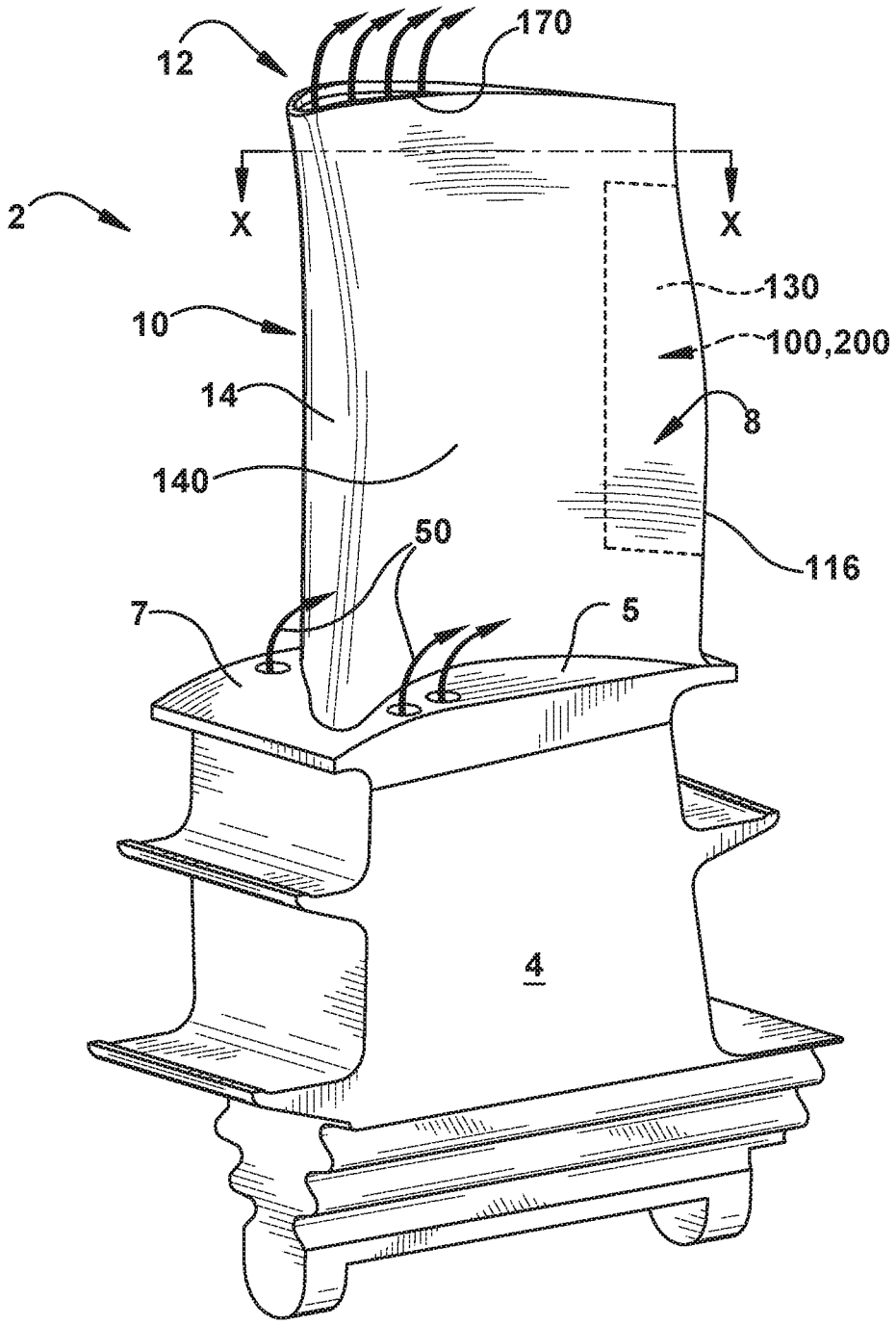
FIG. 1 shows a perspective view of a multi-wall blade/nozzle according to various embodiments.

As an initial matter, in order to clearly describe the current disclosure it will become necessary to select certain terminology when referring to and describing relevant machine components within a gas turbine. When doing this, if possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through the turbine engine or, for example, the flow of air through the combustor or coolant through one of the turbine's component systems. The term "downstream" corresponds to the direction of flow of the fluid, and the term "upstream" refers to the direction opposite to the flow. The terms "forward" and "aft," without any further specificity, refer to directions, with "forward" referring to the front or compressor end of the engine, and "aft" referring to the rearward or turbine end of the engine. It is often required to describe parts that are at differing radial positions with regard to a center axis. The term "radial" refers to movement or position perpendicular to an axis. In cases such as this, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. The term "axial" refers to movement or position parallel to an axis. Finally, the term "circumferential" refers to movement or position around an axis. It will be appreciated that such terms may be applied in relation to the center axis of the turbine.

According to embodiments, a trailing edge cooling circuit with flow reuse is provided for cooling a turbine airfoil of a multi-wall blade/nozzle of a turbine system (e.g., a gas turbine system). A flow of cooling air is reused after flowing through the trailing edge cooling circuit. After passing through the trailing edge cooling circuit, the flow of cooling air may be collected and used to cool other sections of the turbine airfoil, other parts of the blade/nozzle, or other downstream components. For example, the flow of cooling air may be directed to at least one of the pressure or suction sides of the multi-wall blade/nozzle for convection and/or film cooling. Further, the flow of cooling air may be provided to other cooling circuits within the multi-wall blade/nozzle, including tip, and platform cooling circuits.

Traditional trailing edge cooling circuits typically eject the flow of cooling air out through a trailing edge cooling circuit. This is not an efficient use of the cooling air, since the cooling air may not have been used to its maximum heat capacity before being exhausted from the turbine airfoil. Contrastingly, according to embodiments, a flow of coolant (e.g., air), after passing through a trailing edge cooling circuit, is used for further cooling of the multi-wall blade/nozzle in the form of additional convective cooling or film coverage.

Turning to FIG. 1, a perspective view of an illustrative multi-walled turbine blade/nozzle 2 is shown. While FIG. 1 shows blade/nozzle 2 as a turbine rotating blade, it is understood that the teachings of the disclosure are equally applicable to a turbine stationary nozzle vane having similar structure to blade/nozzle 2, but including an outer platform. Consequently, the description shall refer to the blade herein as a blade/nozzle 2. Turbine blade/nozzle 2 includes a shank 4 and a multi-wall turbine airfoil 106 coupled to and extending radially outward from shank 4. Multi-wall turbine airfoil 106 includes a pressure side 8, an opposed suction side 10, and a tip area 12. Multi-wall turbine airfoil 106 further includes a leading edge 14 between pressure side 8 and suction side 10, as well as a trailing edge 116 between pressure side 8 and suction side 10 on a side opposing leading edge 14. Trailing edge 116 includes a cooling circuit configured according to embodiments of the disclosure. Multi-wall turbine airfoil 106 extends radially away from a pressure side platform 5 and a suction side platform 7.

Shank 4 and multi-wall turbine airfoil 106 may each be formed of one or more metals (e.g., nickel, alloys of nickel, etc.) and may be formed (e.g., cast, forged, additively manufactured or otherwise machined) according to conventional approaches. Shank 4 and multi-wall turbine airfoil 106 may be integrally formed (e.g., cast, forged, three-dimensionally printed, etc.), or may be formed as separate components which are subsequently joined (e.g., via welding, brazing, bonding or other coupling mechanism). While the teachings of the disclosure will be described herein relative to blade/nozzle 2, it is emphasized that the teachings are equally applicable to any turbine airfoil, including those employed with stationary nozzles/vanes.

Figure 2:
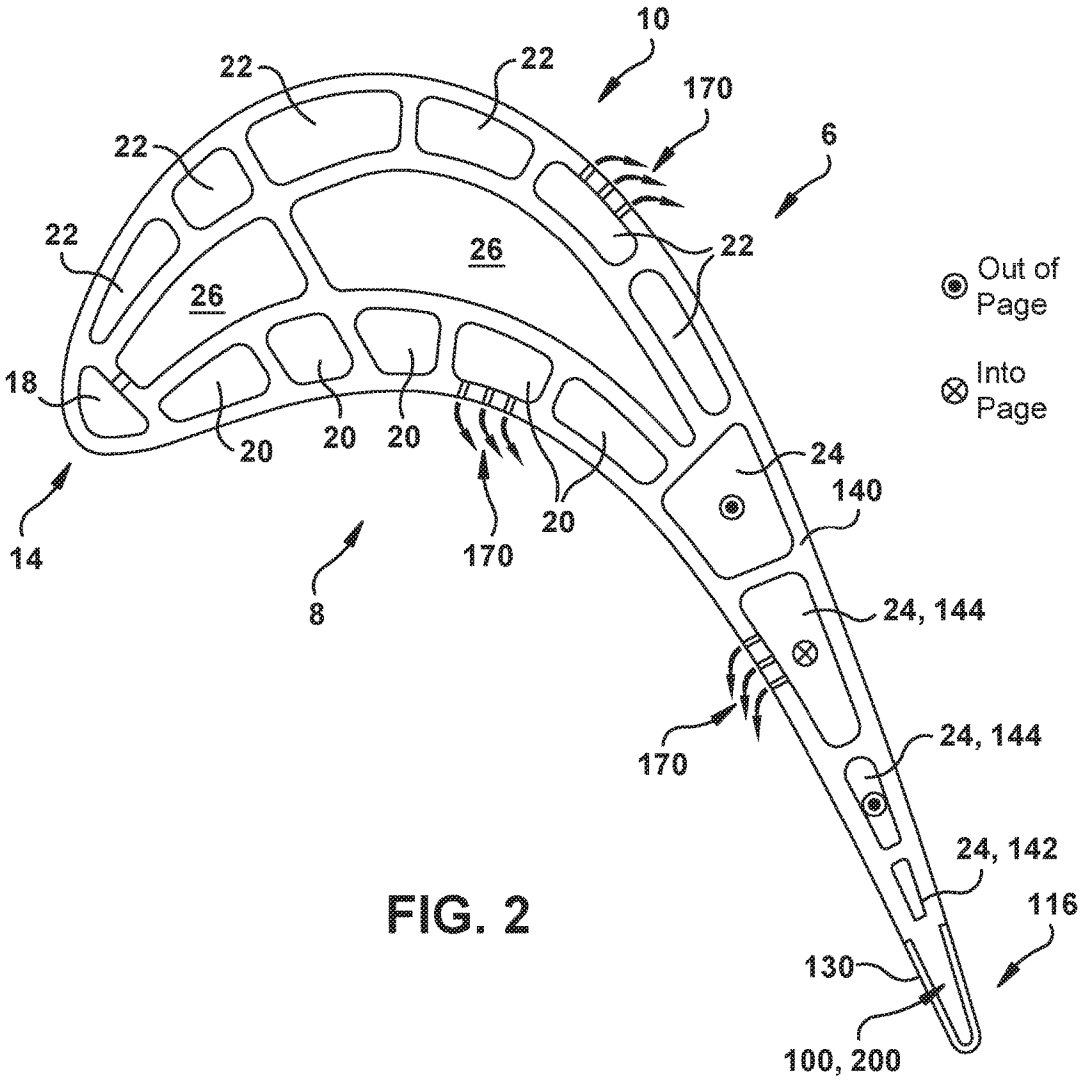
FIG. 2 shows a cross-sectional view of an illustrative multi-wall blade/nozzle according to various embodiments.

FIG. 2 depicts a cross-sectional view of multi-wall turbine airfoil 106 taken along line X-X of FIG. 1. As shown, multi-wall turbine airfoil 106 may include a plurality of internal passages. In embodiments, multi-wall turbine airfoil 106 includes at least one leading edge passage 18, at least one pressure side (near wall) passage 20, at least one suction side (near wall) passage 22, at least one trailing edge passage 24, and at least one central passage 26. The number of passages 18, 20, 22, 24, 26 within multi-wall turbine airfoil 106 may vary, of course, depending upon for example, the specific configuration, size, intended use, etc., of multi-wall turbine airfoil 106. To this extent, the number of passages 18, 20, 22, 24, 26 shown in the embodiments disclosed herein is not meant to be limiting. According to embodiments, various cooling circuits can be provided using different combinations of passages 18, 20, 22, 24, 26.

Figure 3:
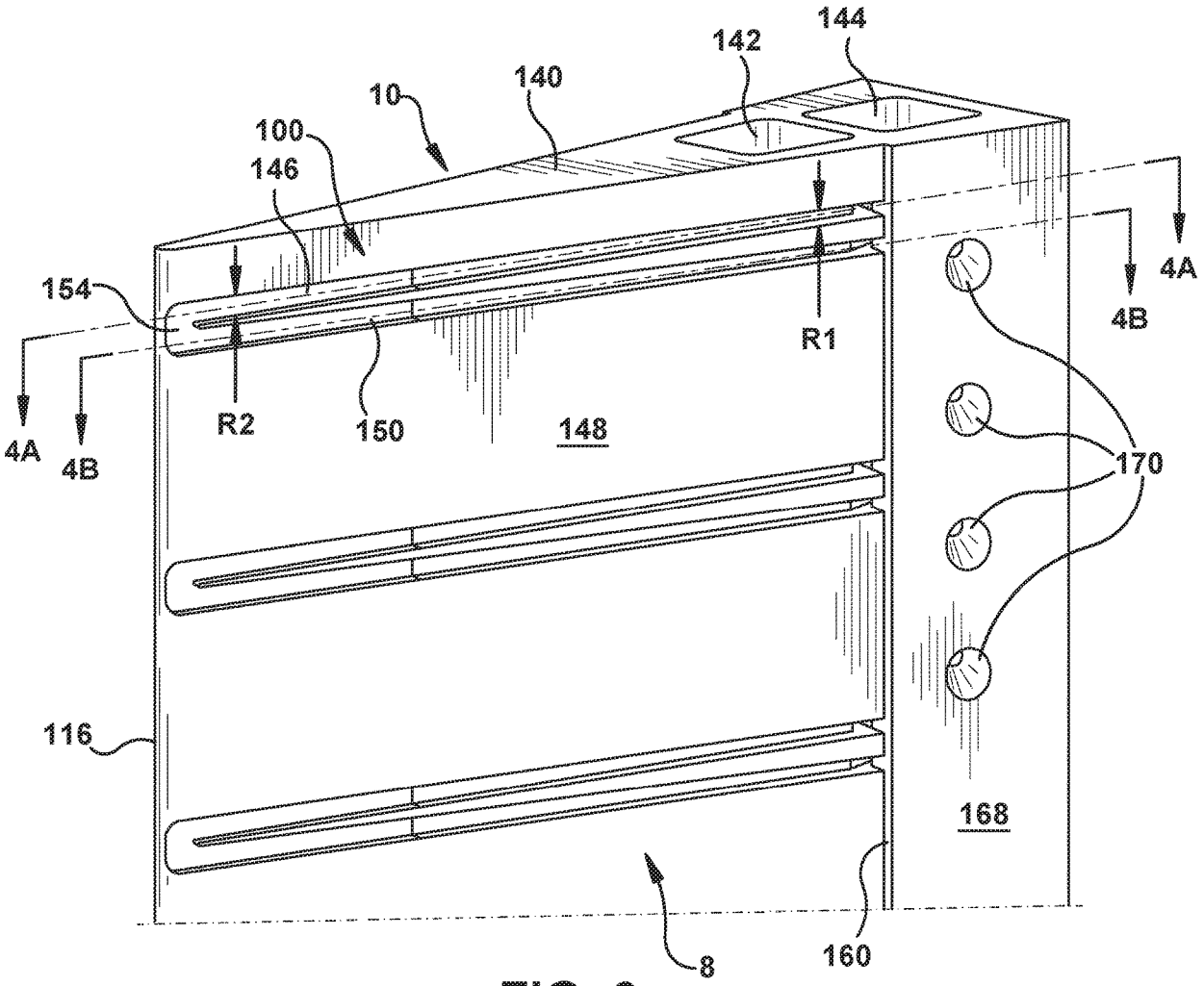
FIG. 3 shows a perspective view of a turbine airfoil body for the multi-wall blade/nozzle including a cooling circuit without a cover according to various embodiments.
Figure 4A:
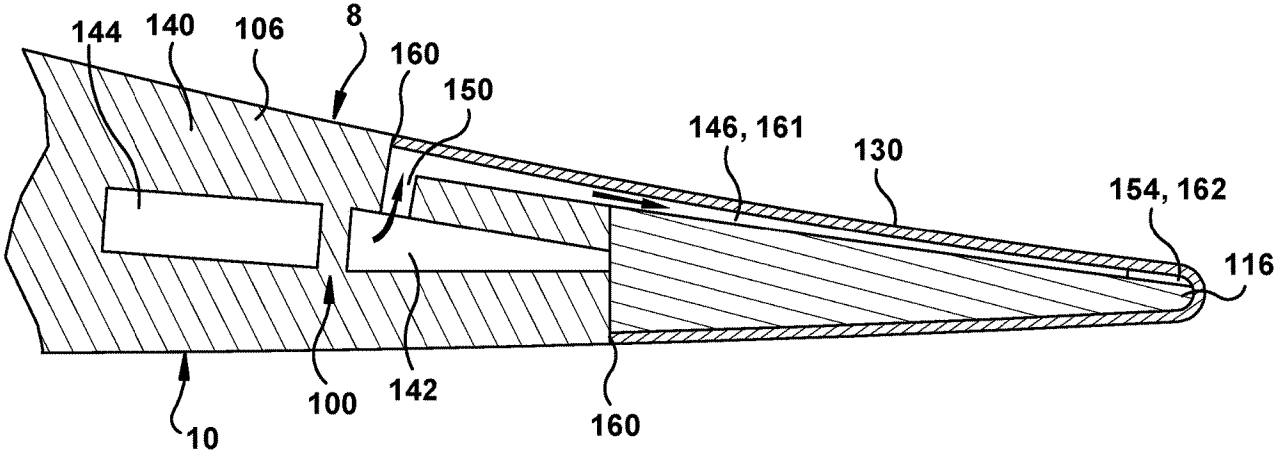
FIG. 4A shows a cross-sectional view of the turbine airfoil body of FIG. 3 along line 4A-4A.
Figure 4B:
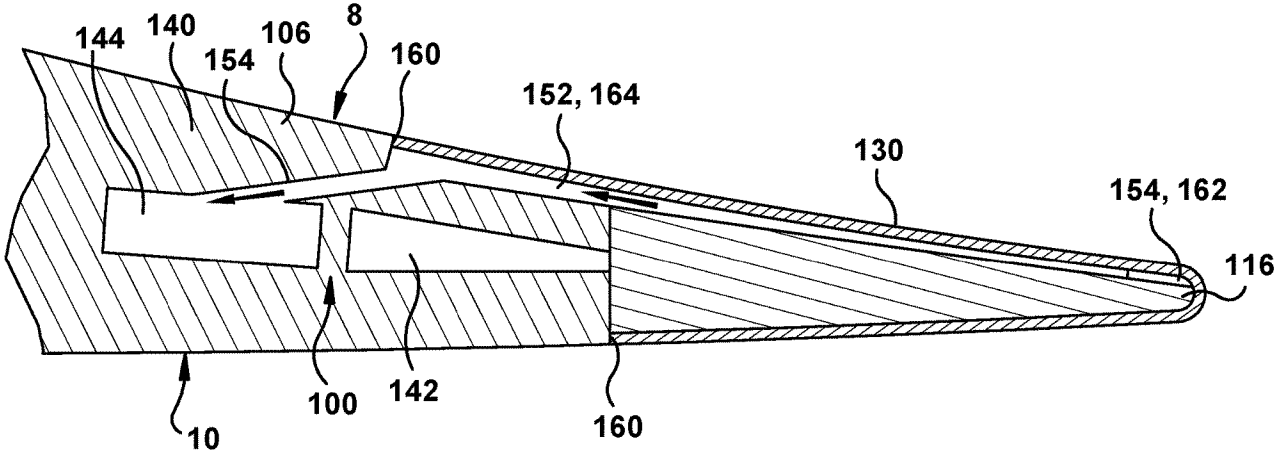
FIG. 4B shows a cross-sectional view of the turbine airfoil body of FIG. 3 along line 4B-4B, each with a cover according to various embodiments.

As shown generally in FIGS. 1-2, a trailing edge cooling circuit 100 in multi-walled turbine airfoil 106 may be formed using a cover 130 in conjunction with trenches (FIGS. 3-7) in an exterior surface of an airfoil body 140 according to embodiments of the disclosure. FIGS. 3-7 depict details of embodiments of trailing edge cooling circuit 100 according to various embodiments. FIG. 3 shows a perspective view of one embodiment of trailing edge 116 of turbine airfoil 106 without a cover 130, and FIGS. 4A-B show an enlarged cross-sectional view of trailing edge 116 along line 4A-4A and line 4B-4B in FIG. 3, respectively, with a cover 130 according to various embodiments. As the name indicates, trailing edge cooling circuit 100 is located adjacent and/or within trailing edge 116 of multi-wall turbine airfoil 106. As noted, turbine airfoil 106 may be employed with a turbine blade or nozzle, as understood in the art.

Turning to FIGS. 3-7, turbine airfoil 106 includes an airfoil body 140 including a leading edge (14 in FIG. 2) and a trailing edge 116. A coolant supply passage 142 may extend within airfoil body 140, and a coolant return passage 144 may extend within airfoil body 140. Coolant supply passage 140 may be coupled to any now known or later developed source of a coolant flow, e.g., a coolant flow generated for example by a compressor 204 (FIG. 8) of a gas turbine system 202 (FIG. 8), flows into trailing edge cooling circuit 100. As illustrate, coolant return passage 144 is immediately forward (upstream) of coolant supply passage 142 within airfoil body 140, but either passage 142, 144 may include any other coolant passage 18, 20, 22, 24 (FIG. 2) within airfoil body 140.

As shown in FIG. 3, turbine airfoil 106 also includes a first trench 146 positioned in an external surface 148 of airfoil body 140. As shown in FIG. 4A, first trench 146 extends to trailing edge 116 from, and is in fluid communication, with coolant supply passage 142. First trench 146 may fluidly communicate with coolant supply passage 142 via a connector passage 150, shown in FIG. 4A. As shown in FIGS. 3 and 4B, turbine airfoil 106 also includes a second trench 152 in external surface 148 of airfoil body 140. As shown in FIG. 4B, second trench 152 extends to trailing edge 116 from, and is in fluid communication with coolant return passage 144 and first trench 146. Second trench 152 may fluidly couple to coolant return passage 144 via a connector passage 154, shown in FIG. 4B. As shown best in FIG. 3, second trench 152 may fluidly communicate with first trench 146 via a bight trench 154, which extends radially in exterior surface 148 to fluidly couple the radially spaced trenches 146, 152. While first and second trenches 146, 152 are shown positioned in external surface 148 of pressure side 8 of turbine airfoil 106, they may alternatively be positioned in suction side 10 of airfoil body 140. Similarly, bight trench 154 may be positioned at trailing edge 116 and in external surface 148 of whichever side 8 or 10 of airfoil body 140 is selected. As shown in FIG. 3 for first trench 146 only (for clarity), each of first and second trench 146, 152 may have a first radial extent R1 at a location upstream of a second radial extent R2 arranged such that second radial extent R2 is larger than first radial extent R1. That is, trenches 146, 152 are radially larger (taller) closer to trailing edge 116 than they are upstream where they fluidly connect to supply and return passages 142, 144 which provides more cooling to trailing edge 116, as described herein. In other embodiments, changes in radial extents R1, R2 may be omitted.

Turbine airfoil 106 also includes a seat 160 in exterior surface 148 of airfoil body 140 for receiving cover 130 (FIGS. 4A-4B). Cover 130 is configured to enclose first and second trenches 146, 152 and form coolant passages with airfoil body 140. Seat 160 may include any necessary shaped edges to mate with and receive cover 130 such that the cover can be coupled to airfoil body 140, e.g., via brazing or welding, followed by any necessary finishing. Turbine airfoil 106 may also include cover 130 configured to mate with trailing edge 116 and exterior surface 148 (on both pressure side 8 and suction side 10) so as to form coolant passages with trenches 146, 152, 154. Cover 130 can be formed in sections, but in any event forms trailing edge 116 in such a way that it is devoid of any coolant passage exiting through the trailing edge. That is, it forms a solid trailing edge 116.

In operation, as shown in FIGS. 4A-4B, coolant is: directed through coolant supply passage 142 (into or out of page), through connector passage 150 to a first coolant passage 161 formed by first trench 146 and cover 130 to trailing edge 116, then through a bight coolant passage 162 formed by bight trench 154 with cover 130 located directly at trailing edge 116, and then returns to return coolant passage 144 by a second coolant passage 164 formed by second trench 152 and cover 130 from trailing edge 116 and connector passage 154. Once in return coolant passage 144, coolant can be reused in any number of ways. For example, in one optional embodiment shown in FIG. 3, a plurality of openings 170 from coolant return passage 144 may exit to a portion of exterior surface 168 of airfoil body 140 upstream from seat 160 so as to form a coolant film on pressure side 8 or suction side 10. As shown in FIGS. 1 and 2, openings 170 can be provided in a large number of alternative positions.

Trenches 146, 150, 152, 154 and seat 160 may be formed in exterior surface 148 of airfoil body 140 in any now known or later developed fashion, e.g., machining, casting, additive manufacturing, etc. Trenches 146, 152 may have a depth into exterior surface 148 in the range of, for example, but not limited to 0 1 millimeters (mm) to 5 mm, depending on the desired cooling and size of turbine airfoil 106. The radial extents R1 and R2 may also range from, but not be limited to 0.1 mm to 10 mm, depending on the structural limits of the cover. As shown in FIG. 3, trailing edge cooling circuit 100, including trenches 146, 152, 154, may repeat in a radially spaced manner along trailing edge 116. Any number of circuits 100 may be employed to provide any desired amount of cooling. Cover 130 may be made of the same material as airfoil body 140 or may be another material, e.g., a pre-sintered preform (PSP) material. As understood, pre-sintered preform is a structure formed of a metal alloy powder pressed into a desired shape. The metal alloy includes brazing alloys therein that assist in brazing connection with airfoil body 140. It is noted, however, that PSP material is just one way of making cover, seat 130 could also be made by casting or additive manufacturing. In any event, cover 130 seals against exterior surface 148 to form passages 161, 162, 164 and is fixed to airfoil body 140.

Figure 5B:
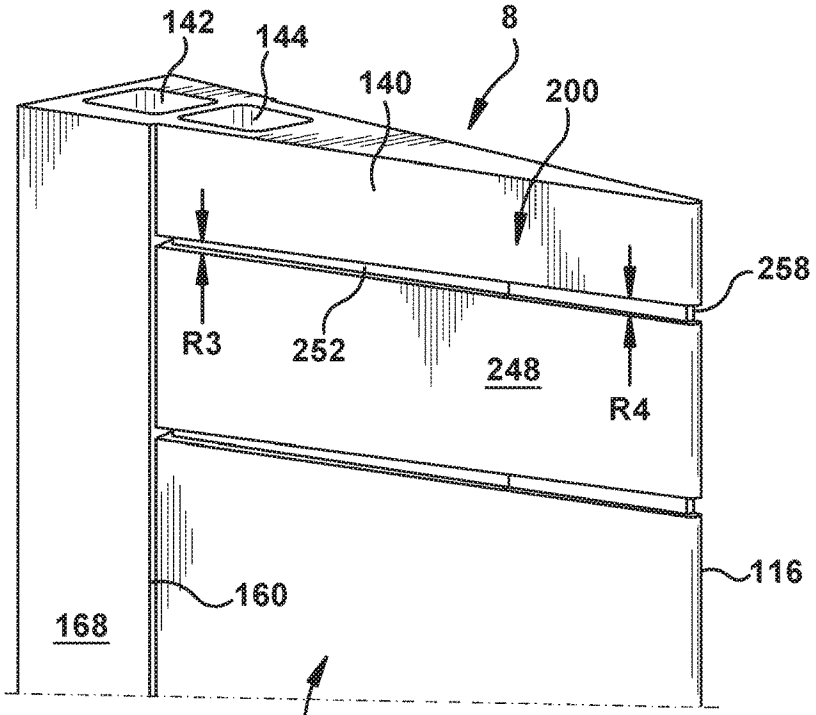
FIG. 5B shows a perspective view of a suction side of the turbine airfoil body of FIG. 5A, according to various embodiments.
Figure 5A:
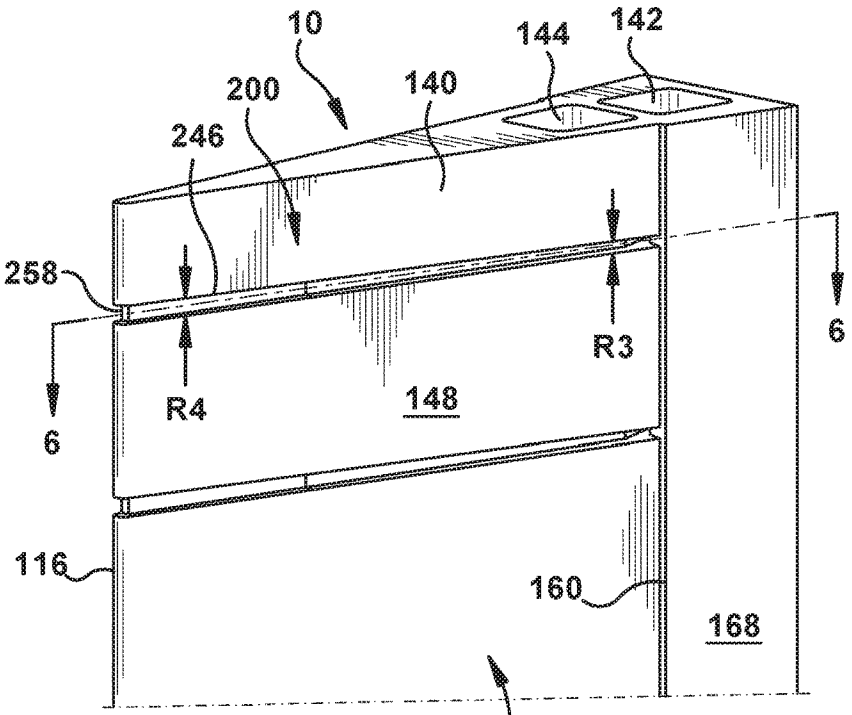
FIG. 5A shows a perspective view of a pressure side of a turbine airfoil body for a multi-wall blade/nozzle including a cooling circuit without a cover.
Figure 6:
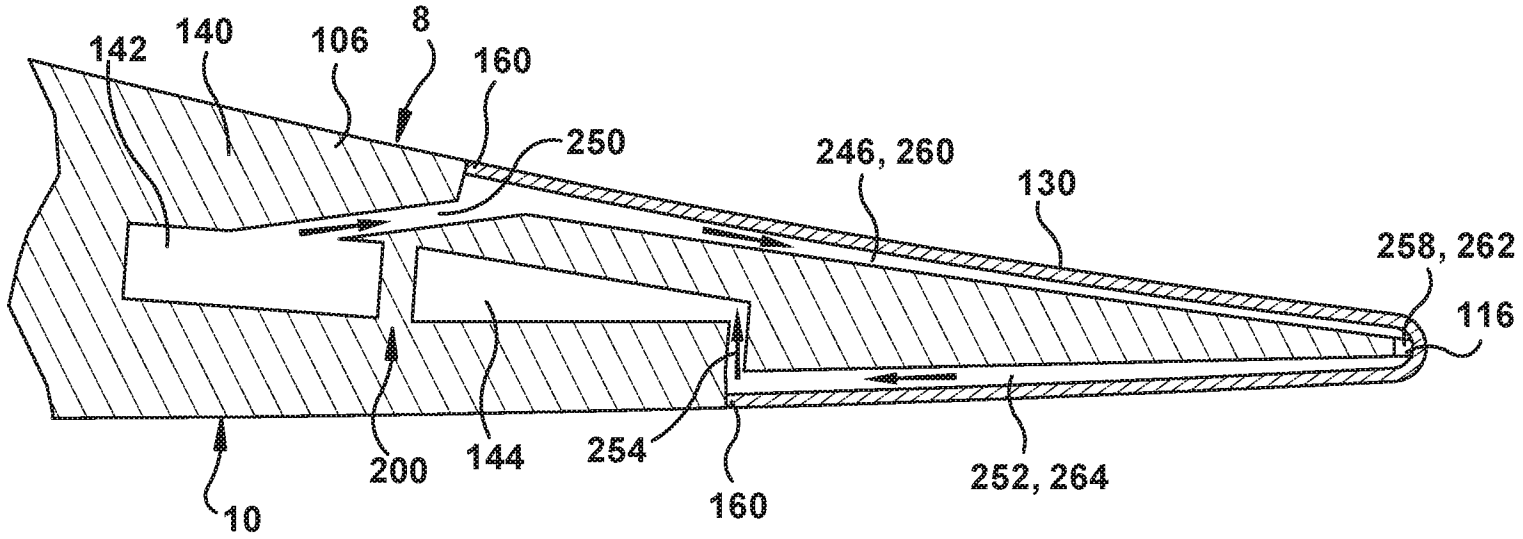
FIG. 6 shows a cross-sectional view of the turbine airfoil body of FIGS. 5A and 5B along line 6-6 with a cover according to various embodiments.

Turning to FIGS. 5A, 5B and 6, another embodiment of a trailing edge cooling circuit 200 is illustrated. FIG. 5A shows a perspective view of suction side 10 of airfoil body 140 for a turbine airfoil 106 (FIG. 1) including a cooling circuit 200, and FIG. 5B shows a perspective view of pressure side 8 of airfoil body 140. FIG. 6 shows a cross-sectional view of airfoil body 140 of FIGS. 5A and 5B along line 6-6. In FIGS. 5A, 5B and 6, in contrast to the FIGS. 3, 4A-B embodiment, coolant return passage 144 is downstream of coolant supply passage 142. In this embodiment, a first trench 246 is positioned in external surface 148 of a selected one of pressure side 8 (as shown in FIG. 5A) and suction side 10 of airfoil body 140, and a second trench 252 is positioned in external surface 248 of the other of pressure side 8 and suction side 10 (as shown in FIG. 5B) of airfoil body 140. In contrast to FIGS. 3 and 4A-B, in this embodiment, first trench 246 is fluidly coupled to second trench 252 by a bight trench 258 spanning trailing edge 116 between external surfaces 148, 248 of pressure side 8 and suction side 10, respectively, of airfoil body 140. That is, trenches 246 and 252 can exchange coolant around trailing edge 116 via bight trench 258. As shown in FIG. 6, first trench 246 fluidly communicates with supply coolant passage 142 via a connector passage 250, and second trench 252 fluidly communicates with return coolant passage 144 via a connector passage 254.

As shown in FIGS. 5A and 5B, each of first and second trench 246, 252 may have a first radial extent R3 at a location upstream of a second radial extent R4 arranged such that second radial extent R4 is larger than first radial extent R3. That is, trenches 246, 252 are radially larger (taller) closer to trailing edge 116 than they are upstream where they fluidly connect to passages 142, 144, which provides more cooling to trailing edge 116, as described herein. In other embodiments, changes in radial extents R3, R4 may be omitted.

In this embodiment, turbine airfoil 106 may also include seat 160 in exterior surfaces 148, 248 of airfoil body 140 for receiving cover 130 (FIG. 6). As in the previous embodiment, cover 130 is configured to enclose first and second trenches 246, 252 and form coolant passages with airfoil body 140. Seat 160 may include any necessary shaped edges to mate with and receive cover 130 such that the cover can be coupled to airfoil body 140, e.g., via brazing or welding, followed by any necessary finishing. Turbine airfoil 106 may also include cover 130 configured to mate with trailing edge 116 and exterior surfaces 148, 248 (on both pressure side 8 and suction side 10) so as to form coolant passages with trenches 246, 252, 258. Cover 130 can be formed in sections, but in any event forms trailing edge 116 in such a way that it is devoid of any coolant passage exiting through the trailing edge. That is, it forms a solid trailing edge 116.

In operation, as shown in FIG. 6, coolant is: directed through coolant supply passage 142 (into or out of page), through connector passage 250 to a first coolant passage 260 formed by first trench 246 and cover 130 to trailing edge 116, then through a bight coolant passage 262 formed by bight trench 258 with cover 130 located directly at trailing edge 116, and then returns to return coolant return passage 144 by a second coolant passage 264 formed by second trench 252 and cover 130 from trailing edge 116 and connector passage 254. Once in return coolant passage 144, coolant can be reused in any number of ways. For example, as a coolant film on pressure side 8 or suction side 10, as in the FIG. 3 embodiment.

Trenches 246, 252, 254 and seat 160 may be formed in exterior surfaces 148, 248 of airfoil body 140 in any now known or later developed fashion, e.g., machining, casting, additive manufacturing, etc. Trenches 246, 252, 258 may have a depth into exterior surfaces 148, 248 in the range of, for example, but not limited to, 0.1 millimeters (mm) to 3 mm, depending on the desired cooling and size of turbine airfoil 106. The radial extents R1 and R2 may also range from, but not be limited to, 0.1 mm to 10 mm depending on the structural capabilities of the cover. As shown in FIG. 6, trailing edge cooling circuit 200, including trenches 246, 252, 254, may repeat in a radially spaced manner along trailing edge 116. Any number of circuits 200 may be employed to provide any desired amount of cooling. Cover 130 here may be made of any of the materials described previously herein. In any event, cover 130 seals against exterior surfaces 148, 248 to form passages 260, 262, 264, and is fixed to airfoil body 140.

Figure 7:
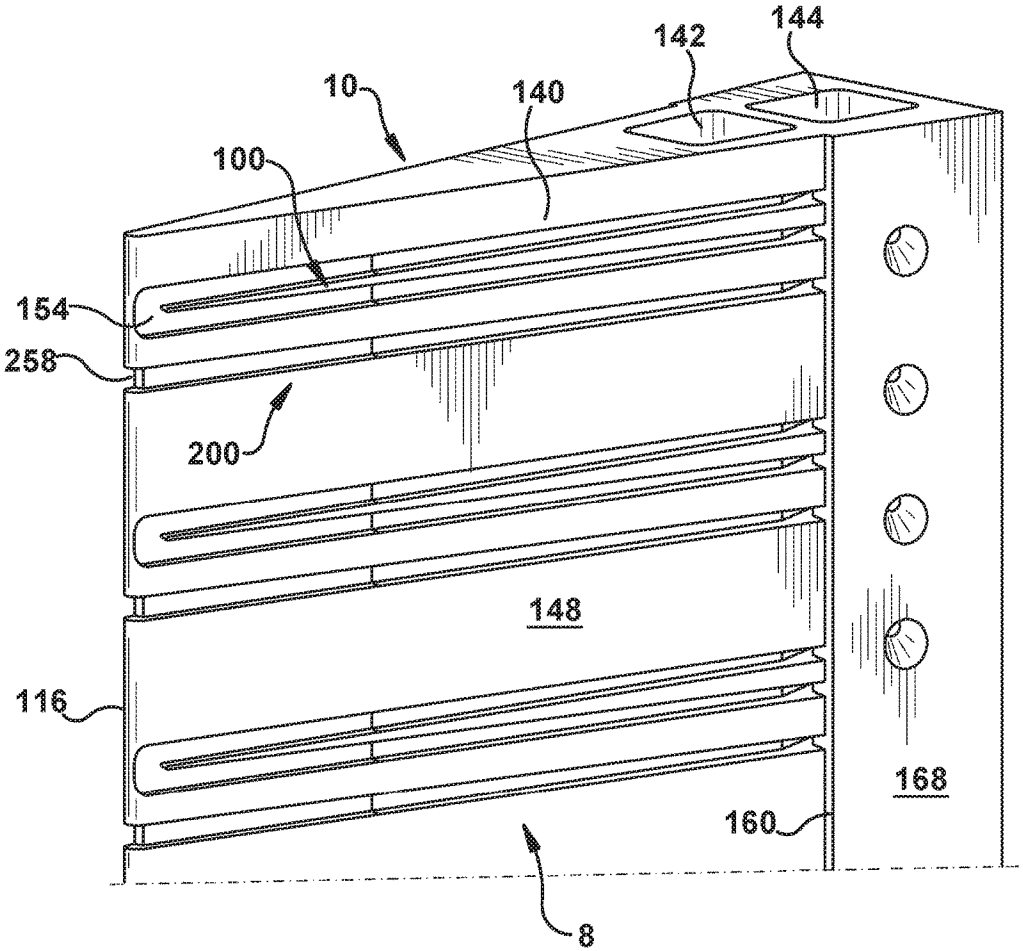
FIG. 7 shows a perspective view of a turbine airfoil body for the multi-wall blade/nozzle including two different cooling circuits according to various embodiments.

Turning to FIG. 7, which shows a perspective view of an airfoil body 140 without cover 130, in another embodiment trailing edge cooling circuits 100, 200 as described herein, may be employed together. They may be arranged in any pattern, e.g., an alternating pattern.

Figure 8:
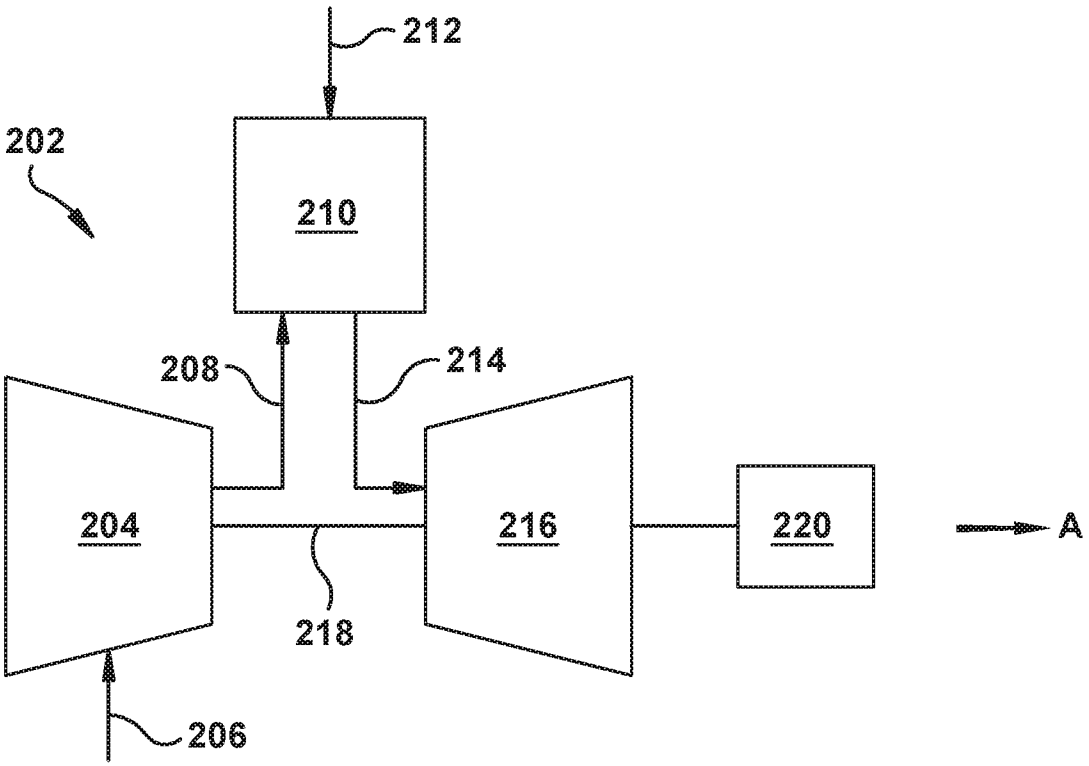
FIG. 8 shows a schematic view of an illustrative turbomachine system employing a turbine blade and/or nozzle including a turbine airfoil according to various embodiments.

FIG. 8 shows a schematic view of gas turbomachine 202 as may be used herein. Gas turbomachine 202 may include a compressor 204. Compressor 204 compresses an incoming flow of air 206, and delivers a flow of compressed air 208 to a combustor 210. Combustor 210 mixes the flow of compressed air 208 with a pressurized flow of fuel 212 and ignites the mixture to create a flow of combustion gases 214. Although only a single combustor 210 is shown, gas turbine system 202 may include any number of combustors 210. The flow of combustion gases 214 is in turn delivered to a turbine 216, which typically includes a plurality of the turbine blades and/or vanes employing a turbine airfoil 106, as described herein. The flow of combustion gases 214 drives turbine 216 to produce mechanical work. The mechanical work produced in turbine 216 drives compressor 204 via a shaft 218, and may be used to drive an external load 220, such as an electrical generator and/or the like.

Turning to FIGS. 9-18, other embodiments of a trailing edge cooling circuit (e.g., 300 in FIG. 10) are illustrated. In these embodiments, in contrast to other embodiments described herein, trench(es) are formed on an interior surface of a cover (e.g., 330 in FIG. 10) and the trench(es) couple supply and return connection passages in an airfoil body (e.g., 340 in FIG. 10) to form coolant passage(s). In any of these embodiments, a trailing edge 316, 416 (e.g., FIGS. 10 and 14) is devoid of any coolant passage exiting through the trailing edge; the coolant is returned for reuse as described previously. As will be apparent from the description that follows, aspects of these embodiments may include a turbine airfoil, a cover and a turbine blade/nozzle including the turbine airfoil and the cover.

Figure 9:
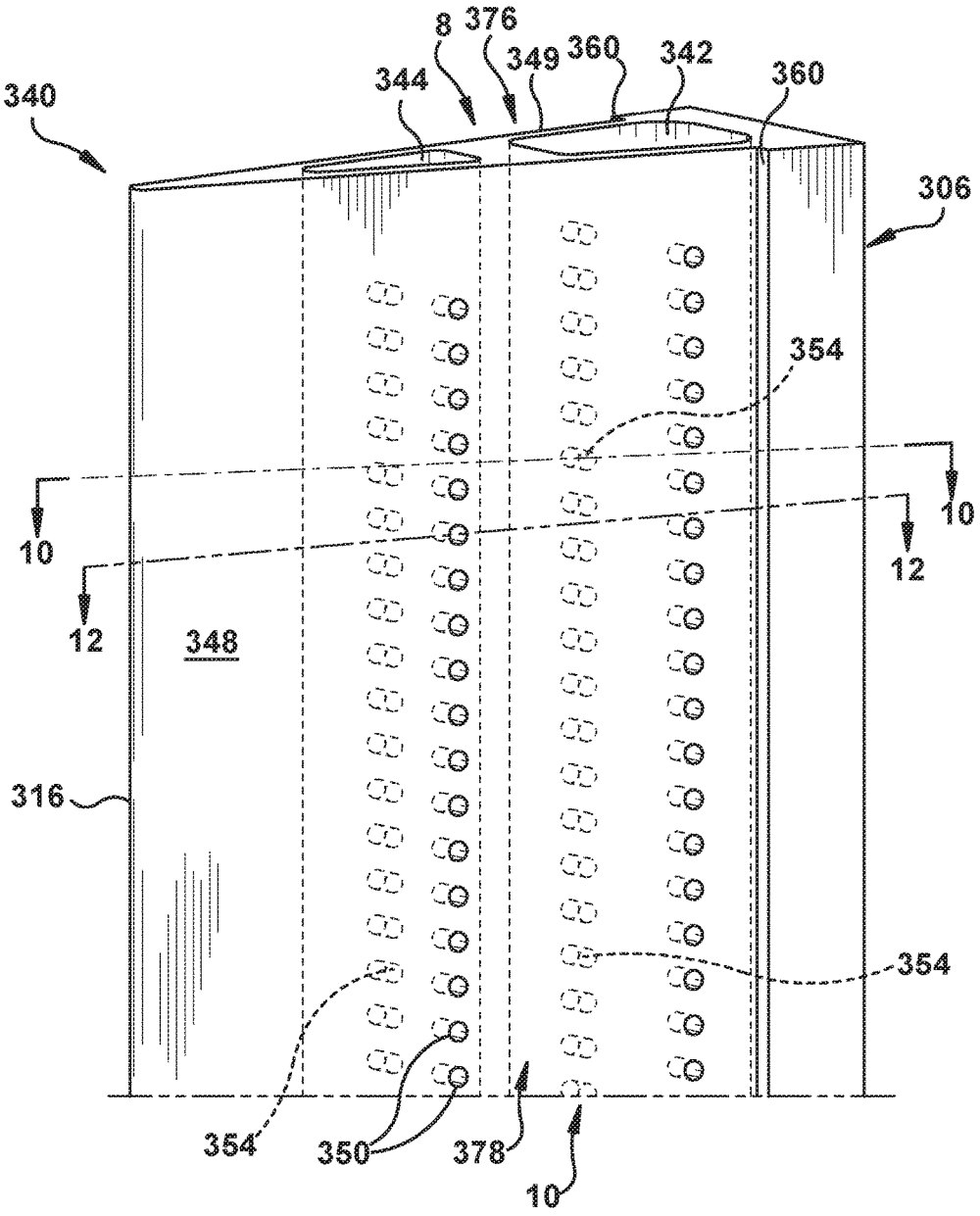
FIG. 9 shows a perspective view of a turbine airfoil body for the multi-wall blade/nozzle including connection passages to coolant passages according to various additional embodiments.
Figure 10:
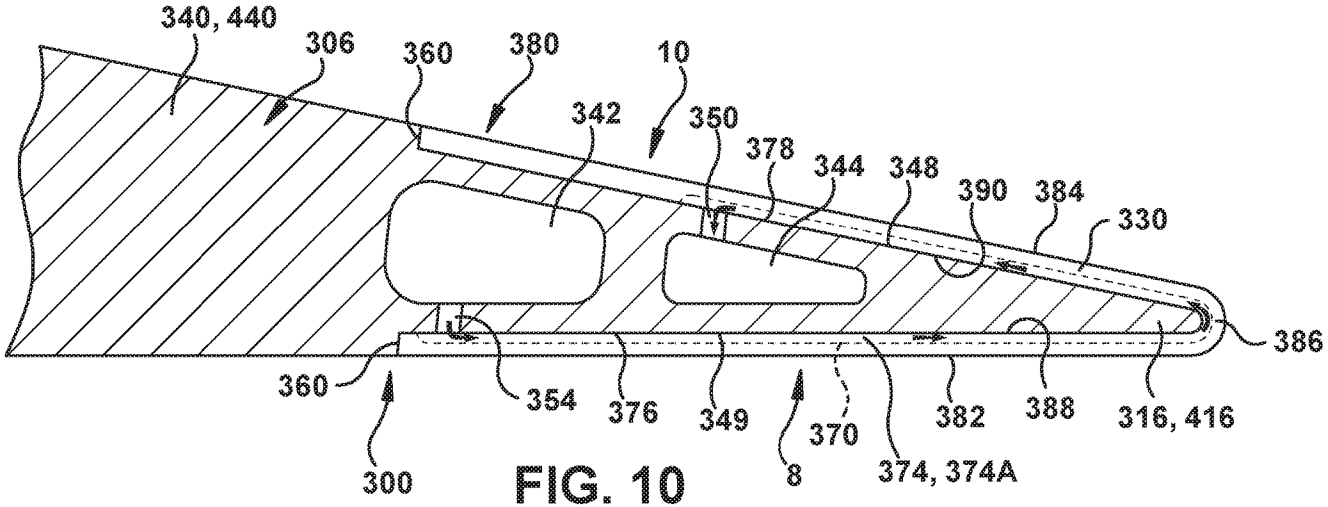
FIG. 10 shows a cross-sectional of the turbine airfoil body along line 10-10 of FIG. 9 with a cover according to various additional embodiments.
Figure 11B:
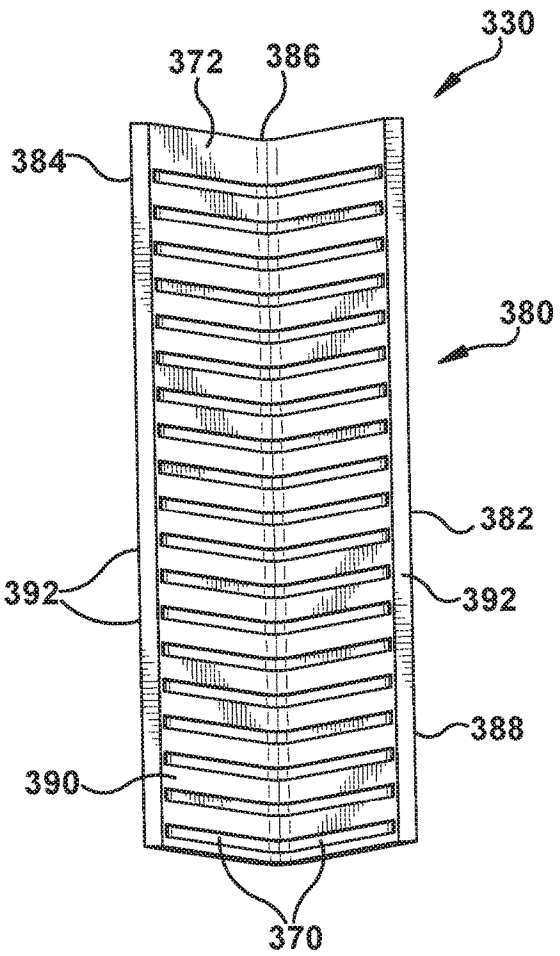
FIGS. 11A-B show perspective views of the cover for a turbine airfoil body according to various additional embodiments.
Figure 11A:
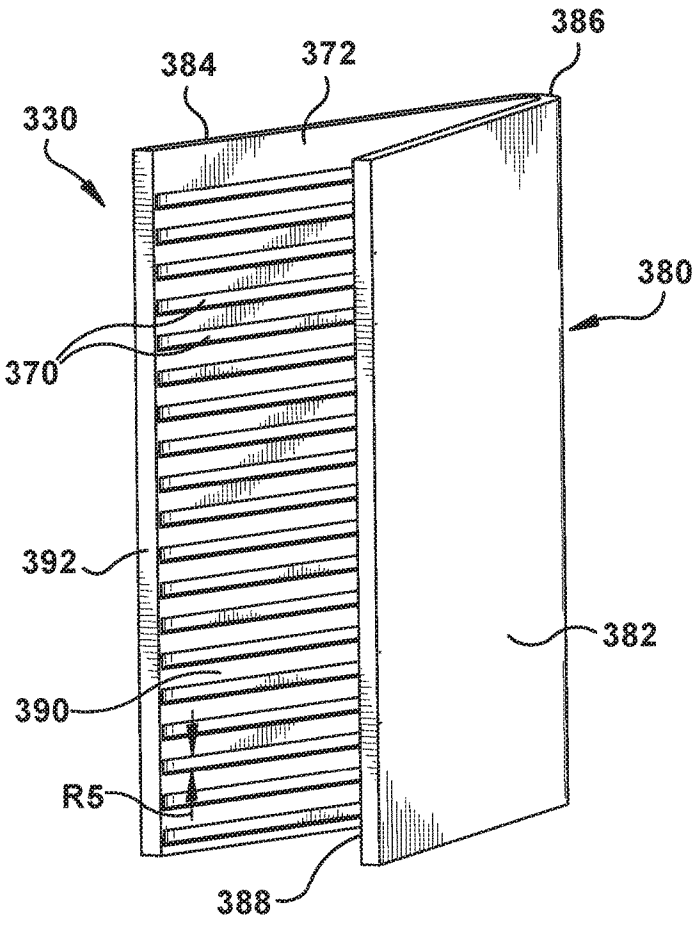

FIG. 9 shows a perspective view of a suction side 10 of an airfoil body 340 for a turbine airfoil 306 (FIG. 10). FIG. 10 shows a cross-sectional view of FIG. 9 along line 10-10, and includes a cover 330, and FIGS. 11A-B show perspective views of cover 330 according to various embodiments. Referring to FIGS. 9, 10 and 11A-B, a turbine airfoil 306 may include airfoil body 340 including an exterior surface 348, 349, a leading edge (not shown) and a trailing edge 316. A coolant supply passage 342 extends within airfoil body 340 and includes a supply connection passage 354 extending to exterior surface 349 (on pressure side 8 as shown) of airfoil body 340. In addition, a coolant return passage 344 extends within airfoil body 340 and includes a return connection passage 350 extending to exterior surface 348 of airfoil body 340 (on suction side 10 as shown). It is noted, that in FIGS. 9-18, a coolant return passage (e.g., 344 in FIG. 9) is downstream of coolant supply passage (e.g., 342 in FIG. 9). The position of the coolant passages, however, may be switched or otherwise rearranged. Turbine airfoil 306 also includes a cover seat 360 in exterior surface 348, 349 of airfoil body 340 for receiving cover 330 (e.g., FIG. 10). Cover seat 360 may be positioned adjacent a portion 376, 378 of exterior surface 349, 348 of airfoil body 340, respectively, to position cover 330 for operation as described herein.

Supply connection passage 354 may be positioned in a portion 376 of external surface 349 of a selected one of a pressure side 8 and a suction side 10 of airfoil body 340, and return connection passage 350 may be positioned in a portion 378 of external surface 348 of the other of pressure side 8 and suction side 10 of airfoil body 340. In the example shown in FIG. 9, supply connection passage 354 is in pressure side 8 and return connection passage 350 is in suction side 10. It will be readily understood that the positions may be switched. Any number, i.e., one or more, supply connection passage 354 and return connection passage 350 may be employed, depending on such factors as cooling desired, coolant flow volume available, etc. As illustrated, supply connection passage includes a first plurality of radially spaced supply connection passages 354 extending from coolant supply passage 342 in airfoil body 340, and return connection passage 344 includes a first plurality of radially spaced return connection passages 350 extending from coolant return passage 344 in airfoil body 340. As noted, radially spaced supply connection passages 350 and radially spaced return connection passages 354 are illustrated on opposing sides (pressure and suction sides 8, 10, respectively) of airfoil body 340.

As shown in FIG. 10, and with reference to FIGS. 11A-B, cover 330 may be positioned in cover seat 360 to cover portion(s) 376, 378 of exterior surface(s) 348, 349 of airfoil body 340. Cover 330 includes a trench 370 on an interior surface 372 thereof to fluidly connect return connection passage 350 and supply connection passage 354 and form a coolant passage 374 for airfoil body 340. In this fashion, one or more coolant passages 374 may be formed. Each trench 370 in internal surface 372 of cover 330 is configured to fluidly connect a supply connection passage 354 to a return connection passage 350, and may be radially spaced in a similar manner to match passages 354, 350. Although the figures show a one-to-one match between supply connection passage 354, return connection passage 350 and trenches 370, it is emphasized that trenches 370 may be configured to collect coolant from more than one supply and deliver the coolant to more than one return.

As shown in FIGS. 11A-B, in order for cover 330 to mate with airfoil body 340, cover 330 may include an angled member 380 configured to cover portion 376, 378 of exterior surface 349, 348 of airfoil body 340. Angled member 380 may include a suction side portion 382 and a pressure side portion 384 coupled to suction side portion 382 at an angle at a connection region 386. Interior surface 372 of cover 330 includes an internal pressure side surface 388 for mating with portion 376 of exterior surface 349 of airfoil body 340 on a pressure side 8 of airfoil body 340, and an internal suction side surface 390 for mating with portion 378 of exterior surface 348 of airfoil body 140 on a suction side 10 of airfoil body 340. As used herein, "mating" indicates cover 330 interior surfaces interacts with the relevant exterior surfaces of airfoil body 340 to form coolant passages 374. The angle provided may be any necessary to accommodate trailing edge 316 and exterior surfaces 348, 349 of airfoil body 340. Cover 330 may be formed using any of the previously described materials and/or processes, and may be coupled to seat 360 using any previously described process, e.g., brazing. Trenches 370 may be formed in cover 330 and seat 360 in airfoil body 140 in any now known or later developed fashion, e.g., machining, casting, additive manufacturing, etc. Trenches 370 may have a depth into cover 330 in the range of, for example, but not limited to, 0.1 millimeters (mm) to 3 mm, depending on the desired cooling and size of turbine airfoil 306. The radial extent R5 of each trench 370 may also vary over its length, and range from, for example, 0.1 mm to 10 mm depending on the structural capabilities of the cover. Any number of trenches 370 and thus any number of cooling circuits 300 (FIG. 10) may be employed to provide any desired amount of cooling.

In the FIG. 10 embodiment, and with reference to FIGS. 11A-B, trench(es) 370 extend contiguously along interior surface 372 from internal pressure side surface 388 to internal suction side surface 390 to fluidly connect supply connection passage 354 and return connection passage 350 and form coolant passage(s) 374 for airfoil body 340. Where more than one trench is provided, each trench 370 may fluidly connect a respective supply connection passage 354 and a respective return connection passage 354 to form a plurality of coolant passages 374 for airfoil body 340. Each trench 370 may stop prior to a respective edge 392 of angled member 380, or may pass through edge 392 and be terminated by seat 360 interacting with edge 392. In any regard, trench 370 extends through connection region 386, i.e., around and within a trailing edge created within cover 330. That is, trench(es) 370 extend on interior surface 372 of cover 330 from coolant supply connection passage 354 on one side of airfoil body 340 (suction side 8 shown) to connection region 386, through connection region 386 from one side of airfoil body 340 to the other side (pressure to suction as shown in FIG. 10), then from connection region 386 to return connection passage 350 on the other side of the airfoil body 340. Thus, in operation as shown by arrows, coolant can pass through coolant passage 374 from coolant supply passage 342 to supply connection passage 354, along suction side 8, through connection region 386 (at trailing edge formed by cover 330), and then return along suction side 10 to return connection passage 350 and coolant return passage 344. Since coolant supply passage 342 is upstream of coolant return passage 344, in FIG. 10, more of pressure side 8 (which is typically exposed to hotter gases) is cooled than suction side 10. If the side 8 or 10 in which each of supply connection passages 354 and return connection passages 350 were switched in airfoil body 340, as shown in the cross-sectional view of FIG. 12, the opposite effect would occur and suction side 10 would be exposed to more coolant. In any event, any number of coolant passages 374 may be formed to cool all or selected portions of turbine airfoil 306. The used coolant can be reused in any manner previously described herein.

Referring to FIGS. 13-18, the position and configuration of supply and return connection passages within an airfoil body, and the position and configuration of trenches within a cover may take a variety of alternative forms to provide highly customized cooling.

Figure 13:
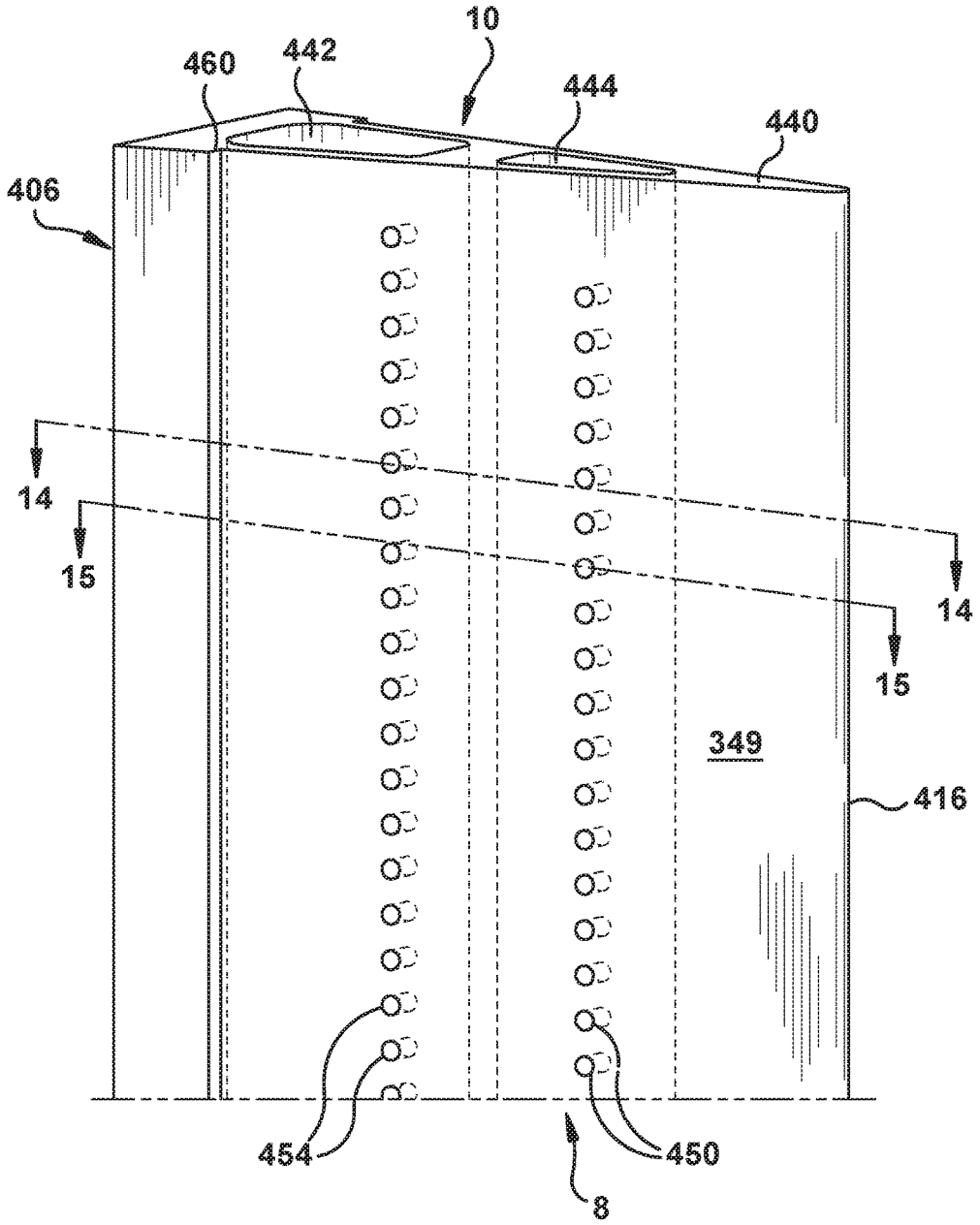
FIG. 13 shows a perspective view of a turbine airfoil body for the multi-wall blade/nozzle according to various additional embodiments.
Figure 14:
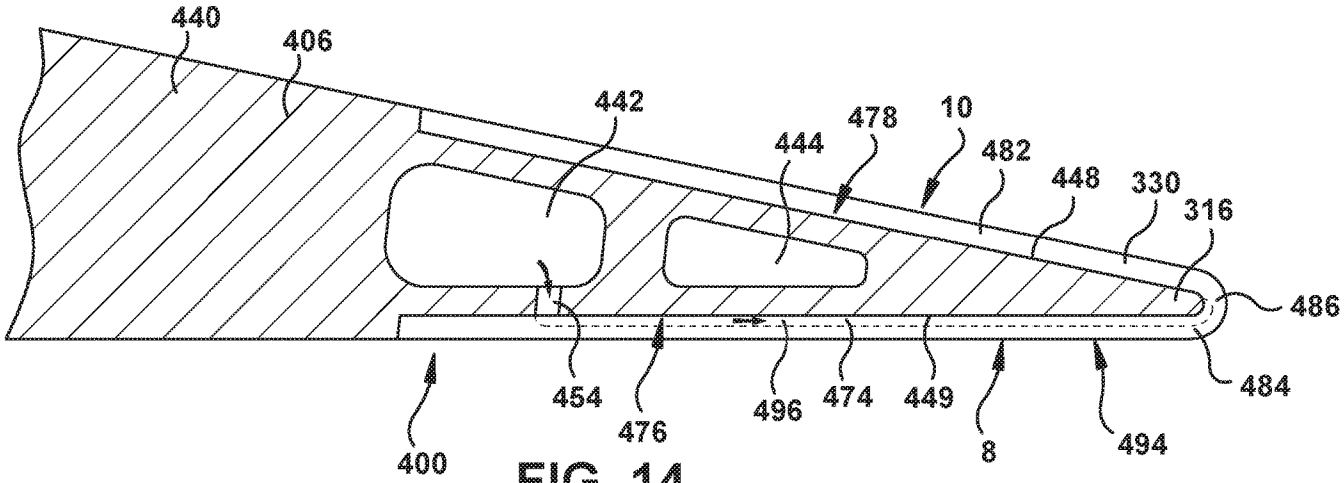
FIG. 14 shows a cross-sectional of the turbine airfoil body along line 14-14 of FIG. 13 with a cover according to various additional embodiments.
Figure 15:
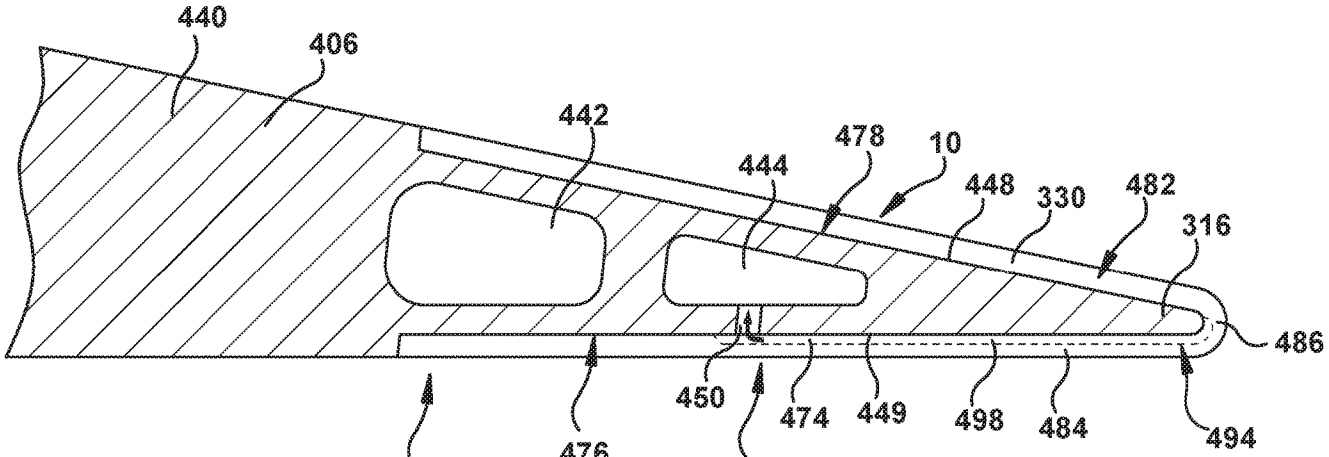
FIG. 15 shows a cross-sectional of the turbine airfoil body along line 15-15 of FIG. 13 with a cover according to various additional embodiments.

FIG. 13 shows a perspective view of an airfoil body 440 for a turbine airfoil 406 according to another embodiment. In this embodiment, airfoil body 440 includes seat 460, supply connection passage(s) 454, and return connection passage(s) 450 positioned in portion 476 of external surface 449 of a selected side of airfoil body 440, i.e., either pressure side 8 (as shown) or suction side 10 of airfoil body 440. That is, connection passages 450, 454 open to the same side, e.g., suction side 8 as shown. Each connection passage 450, 454 is fluidly connected to a respective coolant supply passage 442 and coolant return passage 444, as previously described herein. Here, connection passages 450, 454 are not radially aligned, i.e., they're radially offset from one another to allow fluid connection via trench 470 as will be described. FIG. 14 shows a cross-sectional view of turbine airfoil 406 (with cover 430) through a supply connection passage 450 along line 14-14 in FIG. 13, and FIG. 15 shows a cross-sectional view of turbine airfoil 406 (with cover 430) through a return connection passage 454 along line 15-15 in FIG. 13. As shown in the cross-sectional views of FIGS. 14 and 15, and the perspective views of FIG. 16A of a cover 430, in this embodiment, cover 430 includes angled member 480 having a suction side portion 482 and a pressure side portion 484 coupled to suction side portion 482 at an angle at a connection region 486. The angle provided may be any necessary to accommodate trailing edge 416 and exterior surfaces 448, 449 of airfoil body 440. Interior surface 470 of cover 430 includes an internal pressure side surface 488 for mating with portion 476 of exterior surface 449 of airfoil body 440 on pressure side 8 of airfoil body 440, and an internal suction side surface 490 for mating with portion 478 of exterior surface 448 of airfoil body 140 on a suction side 10 of airfoil body 440.

Figure 16B:
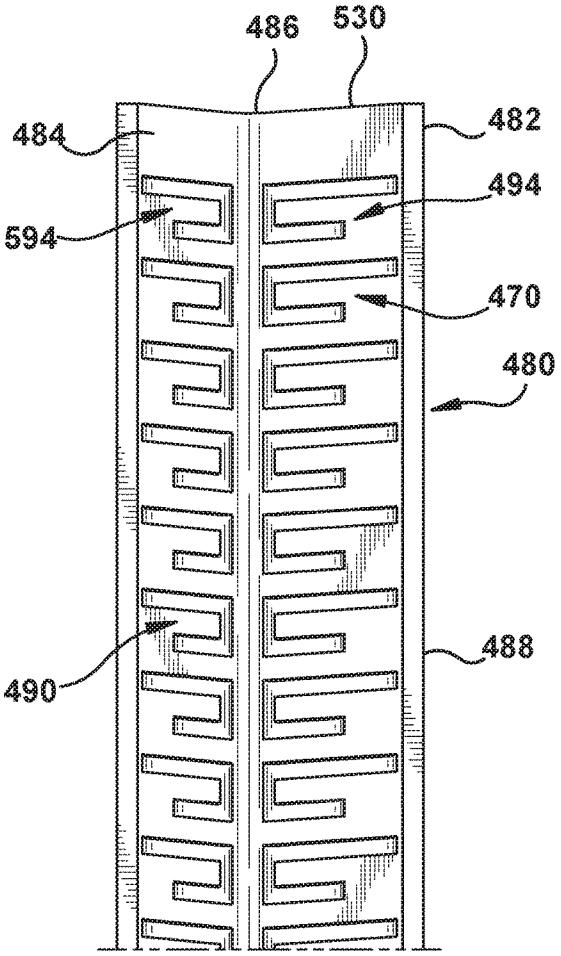
FIG. 16B shows a perspective view of a cover for a turbine airfoil body according to another embodiment.
Figure 16A:
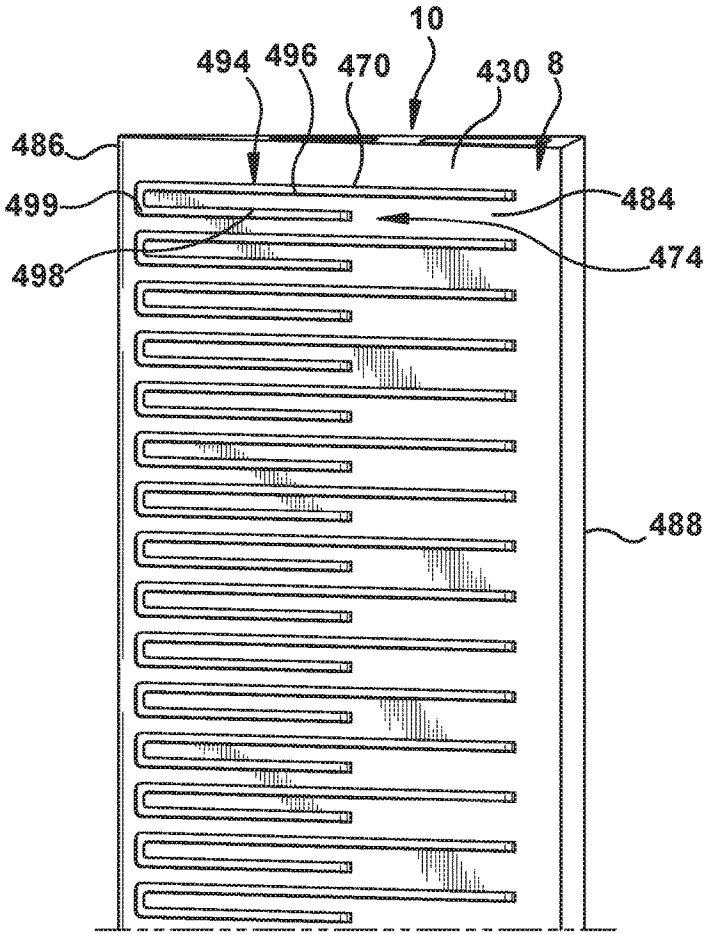
FIG. 16A shows a perspective view of a cover for the turbine airfoil body of FIG. 13 according to one embodiment.

As shown in FIG. 16A, according to one embodiment, trench(es) 470 includes a first trench 494 extending in a selected one the interior suction side surface 482 and the interior pressure side surface 484 (pressure side 482 as shown) corresponding to a selected side (pressure side 8 as shown) of airfoil body 8. As shown in FIG. 14 and FIG. 16A, first trench 494 extends from supply connection passage 454 (FIG. 14) to connection region 486 (labeled first portion 496). (In FIG. 16A, an internal suction side surface (hidden by airfoil body 440) of cover 430 covers suction side 10 but would be devoid of trenches.) As shown in FIGS. 15 and 16A, first trench 494 then extends from connection region 486 to return to connection passage 450 (labeled second portion 498) on suction side 8. As will be understood, first trench 494 forms a coolant passage 474 for airfoil body 440. In this fashion, similar to the FIG. 3 embodiment, coolant may pass downstream on one side (pressure side 8 as shown) of airfoil body 440 and return on the same side, prior to being used elsewhere. As shown in FIG. 16A, at connection region 486, first trench 494 may extend radially along a portion (i.e., a radially extending bight portion 499 of trench 494) of the connection region 486 on the selected side (pressure side 8 as shown) of airfoil body 440 to cool connection region 486 and the trailing edge of airfoil body 440. In one embodiment, bight portion 499 may have the same radial extent as the offset between corresponding supply and return connection passages 450, 454.

Figure 17:
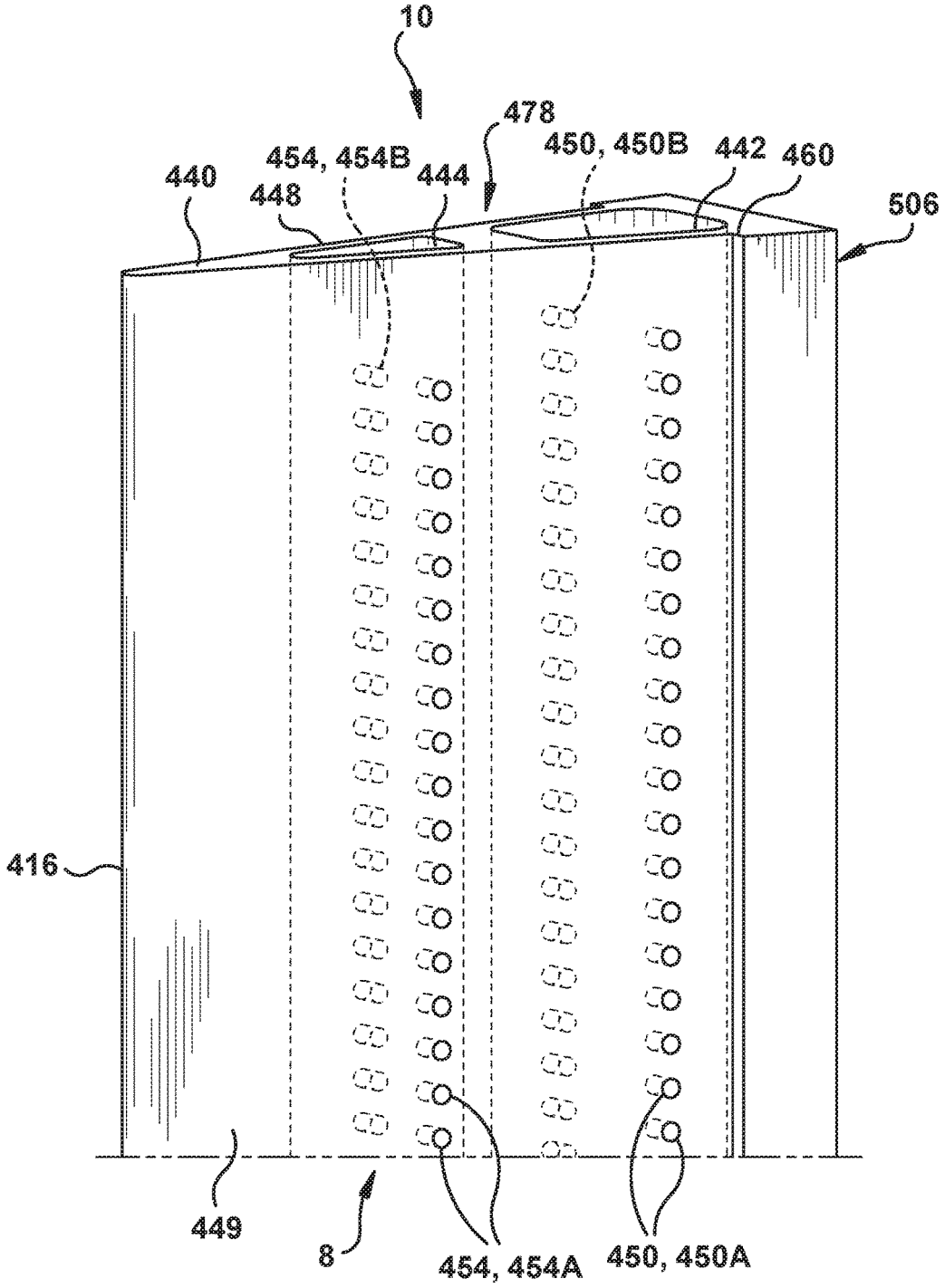
FIG. 17 shows a perspective view of a turbine airfoil body according to various additional embodiments.

Referring to FIG. 16B, another embodiment of a cover 530 is illustrated. Cover 530 allows for a coolant passage 474 such as described relative to FIGS. 13-15 and 16A, to be provided on both sides of turbine airfoil 406. FIG. 17 shows a perspective view of a turbine airfoil 506 to accommodate cover 530. Turbine airfoil 506 is similar to turbine airfoil 406 in FIG. 13 in that it includes connection passages 454A, 450A on suction side 8. In this embodiment, as shown in FIG. 17, supply connection passage 454B and return connection passage 450B may also be positioned in portion 478 of external surface 448 of the other side (suction side 10 as shown) of pressure side 8 and suction side 10 of airfoil body 440. That is, supply connection passage 450 may include a first plurality of radially spaced supply connection passages 450A on pressure side 8 of airfoil body 440 and a second plurality of radially spaced supply connection passages 450B on suction side 10 of airfoil body 440, and return connection passage 454 may include a first plurality of radially spaced return connection passages 454A on pressure side 8 of airfoil body 440 and a second plurality of radially spaced return connection passages 454B on suction side 10 of airfoil body 440. Connection passages 450B, 454B on suction side 10 are not radially aligned similarly to those on pressure side 8, i.e., they're radially offset from one another to allow fluid connection via trench 470 as will be described.

In the FIGS. 16B and 17 embodiments, cover 530, in addition to having trench 470 on internal pressure side surface 488, also has a trench on internal suction side surface 490 thereof. That is, trench 470 also includes a second trench 594 extending in the one of interior suction side surface 490 and interior pressure side surface 488 corresponding to the other side (suction side 10) of airfoil body 440. Trench 594 would have the same structure as shown in FIGS. 14 and 15 for trench 494 except it would be on suction side 10. That is, the trench would extend from supply connection passage 454B to connection region 486, then from connection region 486 to return connection passage 450B to form a coolant passage for airfoil body on suction side 10. A radially extending bight portion (like 499 in FIG. 16A) may also be provided.

Figure 12:
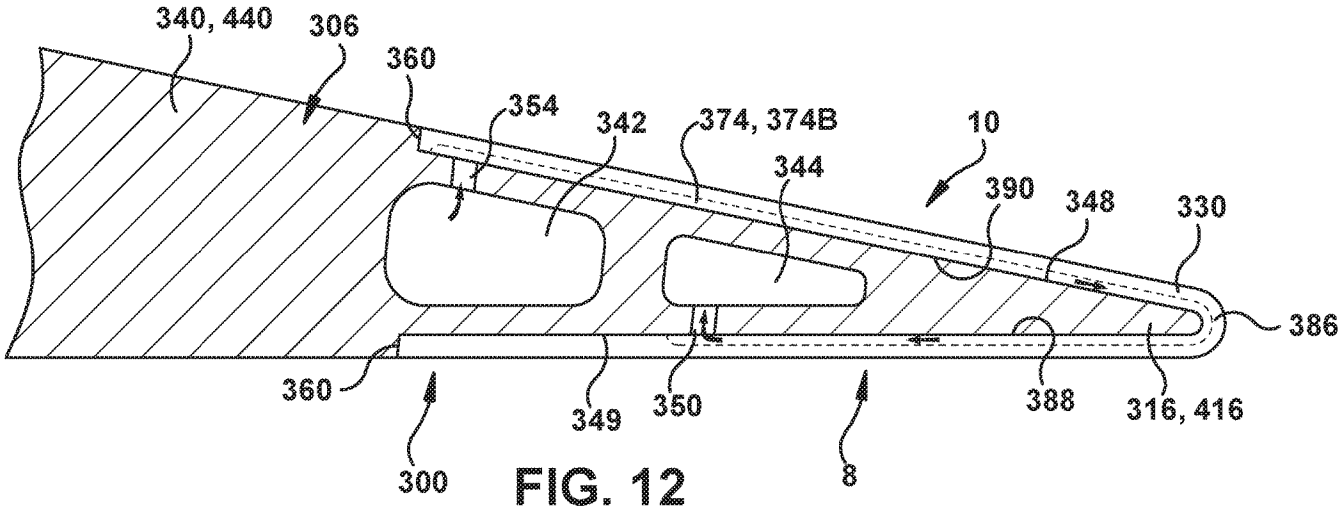
FIG. 12 shows a cross-sectional of the turbine airfoil body along line 12-12 of FIG. 9 with a cover according to various additional embodiments.

With further reference to FIG. 17, where sets of supply connection passages 454A, 454B and return connection passages 450A, 450B are employed, they may be configured such that each supply connection passage 454A on pressure side 8 has a corresponding radially aligned return connection passage 454B on suction side 10, and each supply connection passage 454B has a corresponding radially aligned return connection passage 454A on pressure side 8 of airfoil body 440. In this case, the cooling circuits illustrated in FIGS. 10 and 12 may be employed at the same time to create coolant passages 374A, 374B having opposing flows about trailing edge 416 (FIG. 17) of airfoil body 440. In this case, cover 330 (FIGS. 11A-B) may include a plurality of trenches 370, as described previously. As noted, each trench 370 in cover 330 may extend contiguously along interior surface 372 from internal pressure side surface 388 to internal suction side surface 390 to fluidly connect a respective supply connection passage and a respective return connection passage and form a plurality of coolant passages 374 for airfoil body 340. In this embodiment, however, one trench (or set of trenches) 370 in cover 330 may extend contiguously along the interior surface 372 from internal pressure side surface 388 to internal suction side surface 390 to fluidly connect a respective supply connection passage 454A (on pressure side 8) and a respective return connection passage 450B (on suction side 10) and form a plurality of coolant passages 374A for airfoil body 340. Coolant passages 374A have coolant flow from pressure side 8 to suction side 10, as shown in FIG. 10. At the same time, another trench (or set of trenches) 370 in cover 330 may extend contiguously along the interior surface 372 from internal pressure side surface 388 to internal suction side surface 390 to fluidly connect a respective supply connection passage 454B (on suction side 10) and a respective return connection passage 450A (on pressure side 8) and form a plurality of coolant passages 374B for airfoil body 340. Coolant passages 374B have coolant flow from suction side 10 to pressure side 8, as shown in FIG. 12. In one embodiment, the connection passages 454A-B, 450A-B and trenches 370 may be arranged such that each of the plurality of trenches 370 have coolant flowing in an opposite direction from an adjacent trench.

Figure 18:
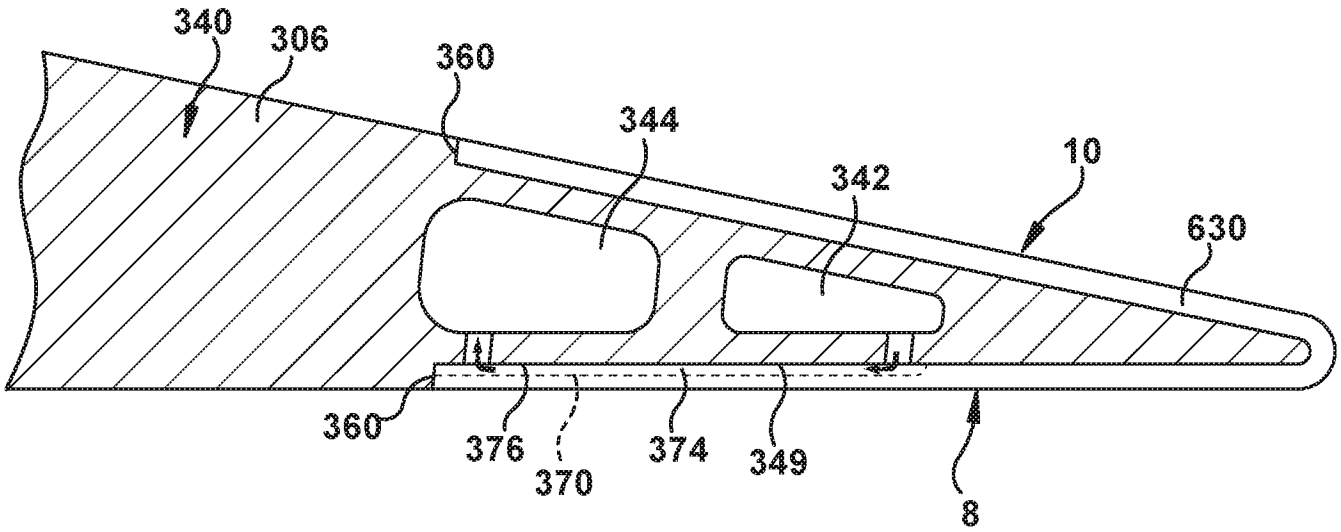
FIG. 18 shows a cross-sectional of a turbine airfoil body with a cover according to various other embodiments.

FIG. 18 shows another embodiment in which trench 370 of cover 630 couples supply connection passage 454 and return connection passage 450 that are on the same side of airfoil body 340. Passages 450, 454 may be radially aligned as shown in FIG. 18 or offset as arranged in FIGS. 14 and 15.

Trailing edge cooling circuits 100, 200, 300 as described herein enables turbine airfoil trailing edges that can be cooled to the tip without having to dump coolant through and out the trailing edge. Circuits 100, 200, 300 thus allow for cooling a turbine component efficiently (high heat transfer, low pressure drop) while also reclaiming/recycling the coolant after it has been used for the trailing edge, so it can be diverted elsewhere in the system. It is understood, however, to provide additional cooling of the trailing edge of multi-wall airfoil/blade and/or to provide cooling film directly to the trailing edge, exhaust passages (not shown) may pass from any part of any of the cooling circuit(s) described herein through the trailing edge and out of the trailing edge and/or out of a side of the airfoil/blade adjacent to the trailing edge. Each exhaust passage(s) may be sized and/or positioned within the trailing edge to receive only a portion (e.g., less than half) of the coolant flowing in particular cooling circuit(s). Even with the inclusion of the exhaust passages(s), the majority (e.g., more than half) of the coolant may still flow through the cooling circuit(s), and specifically the return leg thereof, to subsequently be provided to distinct portions of multi-wall airfoil/blade for other purposes as described herein, e.g., film and/or impingement cooling.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise. "Approximately" as applied to a particular value of a range applies to both values, and unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A turbine airfoil, comprising:

an airfoil body including an exterior surface, a leading edge and a trailing edge;

a coolant supply passage extending within the airfoil body, the coolant supply passage including a supply connection passage extending to the exterior surface of the airfoil body;

a coolant return passage extending within the airfoil body, the coolant return passage including a return connection passage extending to the exterior surface of the airfoil body; and a seat in the exterior surface of the airfoil body for receiving a cover that includes a trench on an interior surface thereof to fluidly connect the return connection passage and the supply connection passage and form a coolant passage for the airfoil body, wherein the trailing edge is devoid of any coolant passage exiting through the trailing edge.

2. The turbine airfoil of claim 1, wherein the supply connection passage is positioned in a portion of the external surface of a selected one of a pressure side and a suction side of the airfoil body, and the return connection passage is positioned in the portion of the external surface of the other of the pressure side and the suction side of the airfoil body.

3. The turbine airfoil of claim 1, wherein the supply connection passage is positioned in the external surface of a selected one of a pressure side and a suction side of the airfoil body, and the return connection passage is positioned in the external surface of the selected one of the pressure side and the suction side of the airfoil body.

4. The turbine airfoil of claim 1, wherein the supply connection passage includes a first plurality of radially spaced supply connection passages extending from the coolant supply passage in the airfoil body, and the return connection passage includes a first plurality of radially spaced return connection passages extending from the coolant return passage in the airfoil body, and wherein the first plurality of radially spaced supply connection passages and the first plurality of radially spaced return connection passages are on opposing sides of the airfoil body.

5. The turbine airfoil of claim 1, wherein the supply connection passage includes a first plurality of radially spaced supply connection passages on a pressure side of the airfoil body and a second plurality of radially spaced supply connection passages on a suction side of the airfoil body, and the return connection passage includes a first plurality of radially spaced return connection passages on the suction side of the airfoil body and a second plurality of radially spaced return connection passages on the pressure side of the airfoil body.

6. The turbine airfoil of claim 5, wherein the first plurality of radially spaced supply connection passages and the second plurality of radially spaced return connection passages on the pressure side of the airfoil body are radially offset from one another, and the second plurality of radially spaced supply connection passages and the first plurality of radially spaced return connection passages on the suction side of the body are radially offset from one another.

7. A turbine blade or nozzle, comprising:

an airfoil body including an exterior surface, a leading edge and a trailing edge;

a coolant supply passage extending within the airfoil body, the coolant supply passage including a supply connection passage extending to a portion of the exterior surface of the airfoil body;

a coolant return passage extending within the airfoil body, the coolant return passage including a return connection passage extending to the portion of the exterior surface of the airfoil body;

a cover seat adjacent the portion of the exterior surface of the airfoil body; and a cover positioned in the cover seat and covering the portion of the exterior surface of the airfoil body, the cover including a trench on an interior surface thereof to fluidly connect the return connection passage and the supply connection passage and form a coolant passage for the airfoil body, wherein the trailing edge is devoid of any coolant passage exiting through the trailing edge.

8. The turbine blade or nozzle of claim 7, wherein the cover includes:

an angled member configured to cover the portion of the exterior surface of the airfoil body, the angled member including a suction side portion and a pressure side portion coupled to the suction side portion at an angle at a connection region, and wherein the interior surface of the cover includes an internal suction side surface for mating with the portion of the exterior surface of the airfoil on a suction side of the airfoil body, and an internal pressure side surface for mating with the portion of the exterior surface of the airfoil on a pressure side of the airfoil body.

9. The turbine blade or nozzle of claim 8, wherein the supply connection passage is positioned in the portion of the external surface of a selected one of the pressure side and the suction side of the airfoil body, and the return connection passage is positioned in the portion of the external surface of the other of the pressure side and the suction side of the airfoil body, and wherein the trench extends contiguously along the interior surface from the internal pressure side surface to the internal suction side surface to fluidly connect the supply connection passage and the return connection passage and form the coolant passage for the airfoil body.

10. The turbine blade or nozzle of claim 8, wherein the supply connection passage and the return connection passage are positioned in the portion of the external surface of a selected side of a pressure side and a suction side of the airfoil body, and wherein the trench includes a first trench extending in a selected one the interior suction side surface and the interior pressure side surface corresponding to the selected side from the supply connection passage therein to the connection region, then from the connection region to the return connection passage therein to form the coolant passage for the airfoil body.

11. The turbine blade or nozzle of claim 10, wherein the supply connection passage and the return connection passage are also positioned in the portion of the external surface of the other side of the pressure side and the suction side of the airfoil body, and wherein the trench includes a second trench extending in the other one the interior suction side surface and the interior pressure side surface of the cover corresponding to the other side of the airfoil body, the second trench extending from the supply connection passage positioned in the portion of the external surface of the other side of the pressure side and the suction side of the airfoil body to the connection region, then from the connection region to the return connection passage positioned in the portion of the external surface of the other side of the pressure side and the suction side of the airfoil body to form the coolant passage for the airfoil body.

12. The turbine blade or nozzle of claim 8, wherein the supply connection passage includes a first plurality of radially spaced supply connection passages in fluid communication with the coolant supply passage in the airfoil body, and the return connection passage includes a first plurality of radially spaced return connection passages in fluid communication with the coolant return passage in the airfoil body, wherein the first plurality of radially spaced supply connection passages and the first plurality of radially spaced return connection passages are on opposing sides of the airfoil body, and wherein the trench includes a plurality of trenches, each trench extending contiguously along the interior surface from the internal pressure side surface to the internal suction side surface of the cover to fluidly connect a respective supply connection passage and a respective return connection passage and form a plurality of coolant passages for the airfoil body.

13. The turbine blade or nozzle of claim 8, wherein the supply connection passage includes a first plurality of radially spaced supply connection passages on a pressure side of the airfoil body and a second plurality of radially spaced supply connection passages on a suction side of the airfoil body, and the return connection passage includes a first plurality of radially spaced return connection passages on the suction side of the airfoil body and a second plurality of radially spaced return connection passages on the pressure side of the airfoil body, and wherein the trench includes a plurality of trenches, each trench extending contiguously along the interior surface from the internal pressure side surface to the internal suction side surface of the cover to fluidly connect a respective supply connection passage and a respective return connection passage and form a plurality of coolant passages for the airfoil body.

14. The turbine blade or nozzle of claim 13, wherein each of the plurality of trenches have coolant flowing in an opposite direction from an adjacent trench.

15. A cover for a trailing edge of an airfoil body of a turbine airfoil, the cover comprising:

an angled member configured to cover the trailing edge of the airfoil body, the angled member including a suction side portion and a pressure side portion coupled to the suction side portion at an angle at a connection region, and an interior surface including a trench for fluidly connecting a coolant supply connection passage in a portion of an exterior surface of the airfoil body with a coolant return connection passage in the portion of the exterior surface of the airfoil body and forming a coolant passage for the turbine airfoil, wherein the angled member is devoid of any coolant passage formed there-through and adjacent the trailing edge such that the turbine airfoil is devoid of any coolant passage exiting through the trailing edge.

16. The cover of claim 15, wherein an interior surface of the cover includes an internal suction side surface for mating with the portion of the exterior surface of the airfoil on a suction side of the airfoil body, and an internal pressure side surface for mating with the portion of the exterior surface of the airfoil on a pressure side of the airfoil body.

17. The cover of claim 15, wherein the coolant supply connection passage and the return connection passage are on the same selected side of the airfoil body, and wherein the trench extends on the interior surface of the cover from the coolant supply connection passage to the connection region, radially along a portion of the connection region on the selected side of the airfoil body, then from the connection region to the return connection passage.

18. The cover of claim 15, wherein the coolant supply connection passage and the return connection passage are on opposing sides of the airfoil body, and wherein the trench extends on the interior surface of the cover from the coolant supply connection passage on one side of the airfoil body to the connection region, through the connection region from one side of airfoil body to the other side, then from the connection region to the return connection passage on the other side of the airfoil body.

* * * * *